US008592116B2

(12) United States Patent
Pang et al.

(10) Patent No.: US 8,592,116 B2
(45) **Date of Patent: *Nov. 26, 2013**

(54) TONER FOR DEVELOPING ELECTROSTATIC CHARGE IMAGE, METHOD OF PREPARING THE SAME, DEVICE FOR SUPPLYING THE SAME, AND APPARATUS AND METHOD FOR FORMING IMAGE USING THE SAME

(75) Inventors: Kyeong Pang, Suwon-si (KR); Tae-hoe Koo, Suwon-si (KR); Su-bum Park, Daegu (KR); Ju-yeon Lee, Suwon-si (KR); Jun-young Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/399,029

(22) Filed: Feb. 17, 2012

(65) Prior Publication Data

US 2012/0214096 A1 Aug. 23, 2012

(51) Int. Cl.
*G03G 9/097* (2006.01)

(52) U.S. Cl.
USPC ..... 430/108.3; 430/108.4; 430/108.8; 430/110.2; 430/111.4

(58) Field of Classification Search
USPC ..... 430/108.4, 108.3, 110.2, 108.8, 109.3, 430/111.4
See application file for complete search history.

(56) References Cited

U.S. PATENT DOCUMENTS

| | | | | |
|---|---|---|---|---|
| 6,617,091 | B2 | 9/2003 | Nishimori et al. | |
| 2011/0014560 | A1* | 1/2011 | Pang et al. | 430/108.4 |
| 2011/0104605 | A1* | 5/2011 | Kim et al. | 430/108.4 |
| 2012/0196218 | A1* | 8/2012 | Hong et al. | 430/105 |

* cited by examiner

*Primary Examiner* — Janis L Dote
(74) *Attorney, Agent, or Firm* — Stanzione & Kim, LLP

(57) ABSTRACT

A toner to develop an electrostatic charge image, a method of preparing the toner, a toner supply device employing the toner, an apparatus to form an image employing the toner, and a method of forming an image using the toner are provided. The toner includes a binder resin including a first type of binder resin having a first weight-average molecular weight and a second type of binder resin having a second weight-average molecular weight different than the first weight-average molecular weight, a colorant, and a releasing agent.

9 Claims, 3 Drawing Sheets

TONER FOR DEVELOPING ELECTROSTATIC CHARGE IMAGE, METHOD OF PREPARING THE SAME, DEVICE FOR SUPPLYING THE SAME, AND APPARATUS AND METHOD FOR FORMING IMAGE USING THE SAME

CROSS-REFERENCE TO RELATED APPLICATIONS

This application claims the benefit of priority under 35 U.S.C. §119 to Korean Patent Application No. 10-2011-0014650, filed on Feb. 18, 2011, in the Korean Intellectual Property Office, the disclosure of which is incorporated herein in its entirety by reference.

BACKGROUND OF THE INVENTION

1. Field of the Invention

The present general inventive concept relates to a toner for developing an electrostatic charge image, a method of preparing the same, a device for supplying the toner, an apparatus and a method of forming the image using the same.

2. Description of the Related Art

Methods of preparing toner particles suitable for use in an electrophotographic process and an electrostatic charge image recording process may generally be classified into a pulverization method and a polymerization method.

Conventionally, toners used for image-forming apparatuses are mainly prepared through the pulverization method. Since the precise control of toner particle size, narrow particle size distribution, and toner shape is difficult in the pulverization method, it is difficult to independently design each property of the toner such as charging, fixation, fluidity, or storage ability.

Recently, a polymerized toner has attracted interest because control of particle diameter and shape is easy and performance of a complex manufacturing process such as classification is not necessary. When a toner is manufactured by using the polymerization method, a polymerized toner having a desired particle size and particle size distribution may be obtained without pulverizing or classification. Since a toner manufactured by using the polymerization method may have a smaller particle diameter and a narrower particle size distribution than one manufactured by the pulverization method, the polymerized toner has advantages such as high charging and transfer efficiency, high resolution through good dot reproducibility and line reproducibility, wide color gamut, low toner consumption, and high image quality. As an example of a method of preparing toner by polymerization, a binder resin, a pigment, wax, etc. are prepared in a form of particulates and an aggregation process is performed thereon after mixing the particulates to form and control a toner particle size. This aggregation process may allow control of a toner particle size and toner particle size distribution with reproducibility. Due to such a property, the aggregation process is currently being used in mass production.

In order to produce a toner having high gloss and a wide fixing latitude, a capsule-type toner prepared by controlling the aggregation process was suggested. The encapsulation of toner certainly contributes to suppression of surface exposure of a pigment and wax, thereby leading uniform charging, fluidity, and heat storage ability. For example, U.S. Pat. No. 6,617,091 describes toner particles which have a resin layer formed on a surface of a colored particle containing a resin and a colorant in order to provide a polymerized toner which has less amount of colorant on the surface of the particle and does not generate changes in image concentration, fogging, and color changes of color image caused by changes in chargeability and developability, even if the toner particles are used to form images under highly humid conditions over extended period of time. However, for example, when the toner includes a large amount of wax, heat storage ability and fluidity of the toner may be reduced because of a plasticizing effect caused by some degree of miscibility between a low molecular weight portion of the wax and the resin.

An anti-offset property of a toner is important in order to secure a stable fixing latitude of a toner. However, in general, when a printing process is performed at a higher speed, the fixing latitude is narrowed. Accordingly, the toner used may differ according to a printing process. In order to solve this problem, there is a need to develop a standardized toner whose fixing latitude is hardly changed according to the speed at which the printing process is performed.

SUMMARY OF THE INVENTION

The present general inventive concept provides a standardized toner having a wide fixing latitude obtained by controlling a viscoelastic property of a toner.

Additional features and utilities of the present general inventive concept will be set forth in part in the description which follows and, in part, will be obvious from the description, or may be learned by practice of the general inventive concept.

Features and/or utilities of the present general inventive concept may be provided by a toner to develop an electrostatic charge image, the toner including a binder resin including: a first type of binder resin having a first weight-average molecular weight and a second type of binder resin having a second weight-average molecular weight different than the first weight-average molecular weight, a colorant, and a releasing agent, wherein the toner has at least one endothermic peak corresponding to melting of the releasing agent, and the at least one endothermic peak is obtained by differential scanning calorimetry (DSC) and includes a main endothermic peak in a temperature range of about 80 to about 100° C. and a secondary endothermic peak in a temperature range of about 60 to about 80° C.

A molecular weight distribution curve of the toner obtained by using a gel permeation chromatography (GPC) method on a tetrahydrofuran (THF) soluble fraction may include a main peak in a molecular weight range of about 10,000 to about 30,000 g/mol and a shoulder starting point in a molecular weight range of about 100,000 to about 300,000 g/mol, and characteristics of the molecular weight distribution curve of the toner may include an amount of molecules having a molecular weight greater than 5,000,000 g/mol is about 0.1 to about 1 wt % based on a total weight of the THF soluble fraction, an amount of molecules having a molecular weight in a range of 1,000,000 g/mol to 5,000,000 g/mol is about 0.5 to about 3 wt % based on the total weight of the THF soluble fraction, an amount of molecules having a molecular weight in a range of 100,000 g/mol to 500,000 g/mol is about 3 to about 10 wt % based on the total weight of the THF soluble fraction, and an amount of molecules having a molecular weight of 20,000 g/mol or less is about 45 to about 70 wt % based on the total weight of the THF soluble fraction.

The toner may have a weight-average molecular weight of about 30,000 to about 500,000 g/mol and a Z-average molecular weight of about 100,000 to about 50,000,000 g/mol, determined from a molecular weight measurement by using a gel permeation chromatography (GPC) method on a THF soluble fraction.

The releasing agent may include a paraffin-based wax and an ester-based wax in an amount of about 10 wt % to about 50 wt % based on a total weight of the paraffin-based wax and the ester-based wax, and a difference between a solubility parameter (SP) of the binder resin and a SP of each of the paraffin-based wax and the ester-based wax is about 2 or more.

An amount of the releasing agent of the toner may be about 9 wt % to about 13 wt % based on a total weight of the toner.

A height ratio of the secondary endothermic peak to the main endothermic peak may be about 0.2 to about 0.5.

A temperature (Ts) at which a shear storage modulus of the toner begins to decrease in a shear storage modulus (G') curve of the toner with respect to temperature may be about 54° C. to about 67° C.

In a shear storage modulus (G') curve of the toner with respect to temperature, S1 represents a value of [log G'(80)−log G'(100)]/20 and may be about 0.03 to about 0.1, S2 represents a value of [log G'(110)−log G'(160)]/50 and may be about 0.01 to about 0.05, a ratio of S1/S2 is about 1.4 to about 5.0, and G'(160) is about 100 to about 3,000, wherein G'(80), G'(100), G'(110), and G'(160) respectively denote shear storage moduli (Pa) at temperatures of 80° C., 100° C., 110° C., and 160° C. at an angular velocity of about 6.28 rad/s, a heating rate of about 2.0° C./min., and an initial strain of about 0.3%.

The toner may include a coagulant including about 1,000 to about 10,000 ppm of iron (Fe) and about 1,000 to about 5,000 ppm of silicon (Si).

The toner may have a core-shell structure including a core layer including the binder resin, the colorant and the releasing agent and a shell layer covering the core layer to suppress exposure of the colorant or releasing agent.

Features and/or utilities of the present general inventive concept may also be provided by a method of preparing a toner to develop an electrostatic charge image, the method including mixing a first binder resin latex including two or more kinds of binder resins having different weight-average molecular weights, a colorant dispersion, and a releasing agent dispersion to prepare a mixture, adding a coagulant to the mixture to form core layer particles including the first binder resin, the colorant, and the releasing agent, and forming toner particles each having a core layer and a shell layer by adding a second binder resin latex to a dispersion of the core layer particles to form the shell layer including the second binder resin on the surfaces of the core layer particles.

The two or more kinds of binder resins may include a low molecular weight resin having a weight-average molecular weight of about 10,000 to about 30,000 g/mol; and a high molecular weight resin having a weight-average molecular weight of about 100,000 to about 5,000,000 g/mol.

A weight ratio of the low molecular weight resin to the high molecular weight resin may be 99:1 to 70:30.

The releasing agent dispersion may include a paraffin-based wax and an ester-based wax in an amount of about 10 wt % to about 50 wt % based on the total weight of the paraffin-based wax and the ester-based wax, and a difference between a solubility parameter (SP) of each of the two or more kinds of binder resins and a SP of each of the paraffin-based wax and the ester-based wax is about 2 or more.

The adding the coagulant to the mixture and the forming toner particles may include: a) aggregating the core layer particles and shell layer particles by adding the coagulant and the second binder resin latex sequentially, and adhering the shell layer particles on the surfaces of the core layer particles in such a temperature range that a shear storage modulus (G') of each of the core layer particle and the shell layer particle is about $1.0\times10^8$ to about $1.0\times10^9$ Pa; b) stopping the aggregating reaction when an average size of particles formed in a) is about 70 to about 100% of an average target size of final toner particles; and c) coalescing the particles in b) to obtain toner particles in such a temperature range that a shear storage modulus (G') of the particles in b) is about $1.0\times10^4$ to about $1.0\times10^8$ Pa.

The coagulant may include a metal salt including silicon (Si) and iron (Fe).

The coagulant may include polysilicate iron.

Features and/or utilities of the present general inventive concept may also be realized by a toner supply device including a toner tank to store a toner, the toner including: a binder resin including a first type of binder resin having a first weight-average molecular weight and a second type of binder resin having a second weight-average molecular weight different than the first weight-average molecular weight, a colorant, and a releasing agent, wherein the toner has at least one endothermic peak corresponding to melting of the releasing agent, and the at least one endothermic peak is obtained by differential scanning calorimetry (DSC) and includes a main endothermic peak in a temperature range of about 80 to about 100° C. and a secondary endothermic peak in a temperature range of about 60 to about 80° C.; a supplying part protruding toward an inner side of the toner tank and to supply the stored toner to outside; and a toner stirring member rotatably installed inside the toner tank and configured to stir the toner in an inner space of the toner tank including an upper portion of the supplying part.

Features and/or utilities of the present general inventive concept may also be realized by an apparatus to form an image, the apparatus including an image carrier, an image forming device to form a latent image on a surface of the image carrier, a toner storage device to store a toner, the toner including: a binder resin including a first type of binder resin having a first weight-average molecular weight and a second type of binder resin having a second weight-average molecular weight different than the first weight-average molecular weight, a colorant, and a releasing agent, wherein the toner has at least one endothermic peak corresponding to melting of the releasing agent and the at least one endothermic peak is obtained by differential scanning calorimetry (DSC) and includes a main endothermic peak in a temperature range of about 80 to about 100° C. and a secondary endothermic peak in a temperature range of about 60 to about 80° C., a toner supply device to supply the toner to the surface of the image carrier to develop the latent image to a toner image on the surface of the image carrier, and a toner transfer device to transfer the toner image from the surface of the image carrier to an image receiving member.

Features and/or utilities of the present general inventive concept may also be realized by a method of forming an image, the method including adhering a toner to a surface of an image carrier on which an electrostatic latent image is formed to form a visible image, the toner including: a binder resin including a first type of binder resin having a first weight-average molecular weight and a second type of binder resin having a second weight-average molecular weight different than the first weight-average molecular weight, a colorant, and a releasing agent, wherein the toner has at least one endothermic peak corresponding to melting of the releasing agent, and the at least one endothermic peak is obtained by differential scanning calorimetry (DSC) and includes a main endothermic peak in a temperature range of about 80 to about 100° C. and a secondary endothermic peak in a temperature range of about 60 to about 80° C.; and transferring the visible image to an image receiving member.

Features and/or utilities of the present general inventive concept may also be realized by, a toner including a binder resin including: a first type of binder resin having a first weight-average molecular weight and a second type of binder resin having a second weight-average molecular weight different than the first weight-average molecular weight, a releasing agent, and a colorant.

A molecular weight distribution of the toner may include a main peak in a molecular weight range of about 10,000 to 30,000 g/mol and a shoulder starting point in a molecular weight range of about 100,000 to 5,000,000 g/mol.

A weight-average molecular weight of the toner may be in a range of about 30,000 to 500,000 g/mol and a Z-average molecular weight of the toner may be in a range of about 100,000 to about 50,000,000 g/mol.

A temperature at which a shear storage modulus of the toner begins to change may be in a range of about 54° C. to 67° C.

The binder resin may include at least one of an addition polymer, a polyester, a polyamide, and a polyimide, wherein the addition polymer is an addition polymer of at least one of a vinyl-based monomer, an acrylic monomer, and an olefin-based monomer.

The releasing agent may include at least one of a polyethylene-based wax, polypropylene-based wax, silicone wax, paraffin-based wax, ester-based wax, carnauba wax, and metallocene wax.

The releasing agent may include at least one of a wax prepared by adding an ester group to a non-ester based wax, and a mixture of an ester-based wax and a non-ester-based wax.

An amount of the releasing agent included in the toner may in a range of about 1 to 20% wt based on a total weight of the toner.

The toner may include a coagulant including silicon (Si) and iron (Fe), wherein a ratio of an intensity of the Si and an intensity of the Fe is in a range of about $5\times10^{-4}$ to $5\times10^{-2}$.

A volume average diameter of the toner may be in a range of about 3 μm to 9.5 μm.

An average circularity of the toner may be in a range of about 0.940 to 0.985.

An amount of the colorant included in the toner may be in a range of about 0.5 to 15 parts by weight based on 100 parts by weight of the toner.

The toner may include a core layer including the binder resin, the releasing agent, and the colorant, and a shell layer to coat the core layer and suppress exposure of the core layer.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
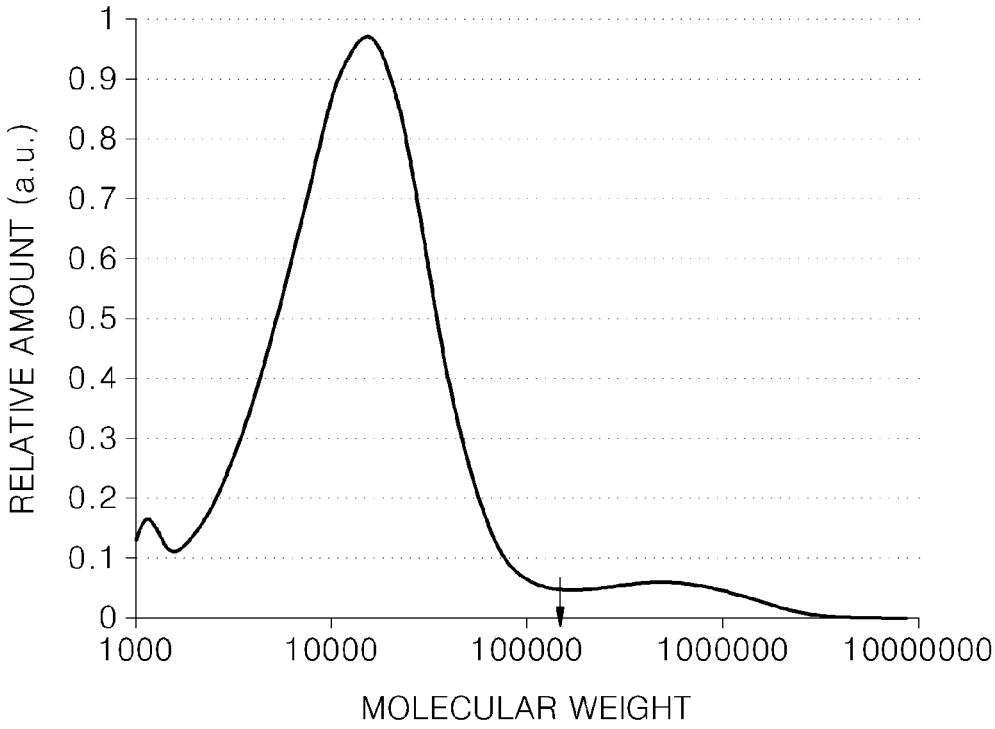
FIG. 1 is a schematic molecular weight distribution curve showing a shoulder starting point.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Hereinafter, a toner for developing an electrostatic charge image, a method of preparing the toner, a toner supply device and an apparatus for forming an image according to exemplary embodiments of the present general inventive concept will, be described in detail.

The terms 'low molecular weight resin' and 'high molecular weight resin' used herein respectively refer to a low average molecular weight resin and a high average molecular weight resin.

A toner to develop an electrostatic charge image according to an embodiment of the present general inventive concept may include a binder resin including at least two resins having different average molecular weights, for example, a low molecular weight binder resin and a high molecular weight binder resin, and a releasing agent having an appropriate compatibility with the binder resins. The toner having such a feature may have certain levels of gloss, a low-temperature fixation, an anti hot-offset property, and heat storage ability.

Specifically, a toner to develop an electrostatic charge image according to an embodiment of the present general inventive concept includes at least a binder resin, a colorant, and a releasing agent, wherein the binder resin includes two or more kinds of binder resins having different weight-average molecular weights, and the toner has a main peak in a low molecular weight range of 10,000 to 30,000 g/mol and a shoulder starting point in a high molecular weight range of 100,000 to 5,000,000 g/mol in a molecular weight distribution curve obtained by tetrahydrofurane (THF)-soluble gel permeation chromatography (GPC).

A molecular weight of a toner affects gloss and fixing properties of the toner, and a molecular weight distribution of a binder resin formed of a polymer resin almost corresponds to a molecular weight distribution of a toner. Accordingly, if one kind of resin is used as a binder resin, a molecular weight distribution curve of a toner has one normal distribution curve. However, if a binder resin including a low molecular weight resin and a high molecular weight resin is used, a molecular weight distribution curve of a toner has a main peak in a molecular weight distribution range corresponding to the low molecular weight resin and a shoulder in a molecular weight distribution range corresponding to the high molecular weight resin, wherein the shoulder indicates a distribution curve portion having a gentle slope connected to an edge of the main peak having a steep slope. If an amount of the high molecular weight resin is too high, a double peak may appear. In this case, a toner formed may have low gloss although an anti-offset property of the toner is excellent. As described above, when a toner is prepared by using an appropriate ratio of a binder resin including two or more kinds of resins having different average molecular weights, the resins may independently perform their functions. That is rheological design for a toner may be performed such that a low molecular weight resin having a critical molecular weight or less has little entanglement between its molecular chains and thus, performs its function in terms of a minimum fixing or fusing temperature (MFT) and a gloss property. A high molecular weight resin having a high molecular weight has many entanglements between its molecular chains and thus, allows a toner to have a certain level of elasticity, thereby contributing to heat storage ability and an anti-offset property. Accordingly, if as in the toner according to an embodiment of the present general inventive concept, a glass transition temperature (Tg) of a binder resin is lowered for low-temperature fixing and the binder resin is encapsulated with a binder resin having a relatively high Tg, problems of a conventional toner having a core-shell structure that has a sufficient low-temperature fixation but an insufficient anti hot-offset property and heat storage ability may be overcome.

Accordingly, the binder resin includes two or more kinds of binder resins having different weight-average molecular weights, and has a main peak in a low molecular weight range of about 10,000 to about 30,000 g/mol, for example, about 10,000 to about 25,000 g/mol in a molecular weight distribution curve obtained by using a gel permeation chromatography (GPC) method on a tetrahydrofuran (THF) soluble fraction. If the main peak is within the above ranges, melt viscosity of the toner may be improved, and thus a gloss property and a fixing property of the toner may be improved.

Also the molecular weight distribution curve of the toner has a main peak having steep slopes and a small secondary peak portion having a gentle slope in which the gentle slope immediately follows the steep slope of the main peak of the higher molecular weight range. That is, a point where the gentle uphill slope of the secondary peak portion begins following an end of the downhill slope of the main peak in the molecular weight distribution curve is referred to as a shoulder starting point.

FIG. 1 is a schematic molecular weight distribution curve showing a shoulder starting point. In FIG. 1, the shoulder starting point in the molecular weight distribution curve is indicated by an arrow.

The shoulder starting point of the toner may be in a high molecular weight range of 100,000 to 500,000 g/mol, for example, about 100,000 to about 300,000 g/mol in the molecular weight distribution curve obtained by using a GPC method on a THF-soluble fraction. If the shoulder starting point range is within the above ranges, an anti hot-offset property of the toner may, be improved, and thus, a wide fixing latitude may be secured and durability and a gloss property of the toner may be improved.

By appropriately combining two or more kinds of binder resins including the low molecular weight binder resin and the high molecular weight binder resin, the toner may have a controlled molecular weight distribution in which i) an amount of molecules having a molecular weight greater than 5,000,000 g/mol is about 0.1 to about 1 wt % based on the total weight of the THF soluble fraction, ii) an amount of molecules having a molecular weight in a range of 1,000,000 g/mol to 5,000,000 g/mol is about 0.5 to about 3 wt % based on the total weight of the THF soluble fraction, iii) an amount of molecules having a molecular weight in a range of 100,000 g/mol to 500,000 g/mol is about 3 to about 10 wt % based on the total weight of the THF soluble fraction, and iv) an amount of molecules having a molecular weight of 20,000 g/mol or less is about 45 to about 70 wt % based on the total weight of the THF soluble fraction. Also the toner may further include molecules having a molecular weight range other than the molecular weight ranges i) to iv). High molecular weight fractions having the molecular weight ranges i) to iii) correspond to the shoulder shape of the secondary peak portion in the high molecular weight range of 100,000 to 5,000,000 g/mol in the molecular weight distribution curve obtained by THF-soluble GPC. A low molecular weight fraction that has the molecular weight range iv) corresponds to a portion of the main peak corresponding to the low molecular weight range of 10,000 to 30,000 g/mol. The small amount of the high molecular weight binder resin may provide an excellent anti hot-offset property, high gloss, heat storage ability, and a low-temperature fixation by being used in combination with a high amount of a low molecular weight binder resin. As described above, by controlling amounts of the high molecular weight and low molecular weight binder resins and a molecular weight distribution, the toner may have a weight-average molecular weight of about 30,000 to about 500,000 g/mol, for example, about 60,000 g/mol to about 250,000 g/mol, and a Z-average molecular weight of about 100,000 to about 50,000,000 g/mol, for example, about 300,000 g/mol to about 10,000,000 g/mol, wherein the molecular weights are determined from a molecular weight measurement by using a GPC method on a THF-soluble fraction. That is since the toner has a weight-average molecular weight of about 30,000 g/mol or more, durability of the toner may be improved and blocking occurring when the toner is stored at high temperature may be suppressed. In addition, when the toner has a weight-average molecular weight of about 500,000 g/mol or less, an excellent fixing property of the toner may be sustained. Meanwhile, the Z-average molecular weight of the toner emphasizes polymer molecules having a high molecular weight in the molecular weight distribution of the toner, and such a distribution affects toughness of molten toner during peeling. Accordingly, if the Z-average molecular weight of the toner is about 100,000 to about 50,000,000 g/mol, the anti-offset property and gloss of the toner may be improved. If the molecular weight is too small, durability of the toner is decreased. On the other hand, if the molecular weight is too large, it is difficult to fix the toner at low temperatures, and a melt viscosity is increased and thus an image deficiency caused by a hot offset and a decrease in gloss caused by an increase in surface roughness may occur. In addition, releasibility may be decreased in an oil-less fixing system.

In a shear storage modulus (G') curve with respect to a temperature of the toner, a temperature (Ts, slope temperature) at which a shear storage modulus of the toner begins to change may be in a range of about 54 to about 67° C. The Ts corresponds to a timing in which thermal deformation of the toner begins as the temperature is increased. When a prepared toner is housed in an apparatus for forming an image, such as a printer, and the apparatus for forming an image is driven, the toner is, in general, exposed to heat that is generated under a particular driving condition, such as high-speed driving or fixing in the apparatus for forming an image, and thus, the temperature of the apparatus for forming an image may be highly likely to be increased up to about 50° C. Accordingly, if the Ts of the toner is about 54° C. or higher, blocking among toner particles caused by thermal deformation of a surface of the toner under driving conditions for an apparatus for forming an image may be prevented. Also, if the Ts of the toner is about 67° C. or less, a low-temperature fixation of the toner may be improved.

In a shear storage modulus (G') curve of the toner with respect to temperature of the toner, which is used to measure viscoelasticity, a value of [log G'(80)−log G'(100)]/20 (S1) of the toner is in a range of about 0.03 to about 0.1, a value of [log G'(110)−log G'(160)]/50 (S2) of the toner is in a range of about 0.01 to about 0.05, a ratio of the two slopes (S1/S2) is about 1.4 to about 5.0, and G'(160) may be about 100 to about 3,000. In this regard, G'(80), G'(100), G'(110), and G'(160) respectively indicate a shear storage modulus (Pa) at a temperature of 80° C., a storage modulus (Pa) at a temperature of 100° C., a storage modulus (Pa) at a temperature of 110° C., and a storage modulus (Pa) at a temperature of 160° C., which are obtained by, measuring dynamic viscoelasticity of the toner by using a two circular disc-shaped rheometer (for example, TA ARES) including a sample disc having a diameter of 8 mm and a height of 1.5 to 2.5 mm at an angular velocity of 6.28 rad/s, a heating rate of 2.0° C./min and an initial strain of 0.3% (the strain is automatically controlled during measurement).

Viscoelasticity of a toner may be dependent upon, for example, thermal properties (glass transition temperature (Tg), melting temperature (Tm) etc.), a degree of cross-linking, dispersibility, compatibility, molecular weight distribution, and materials used of the toner. In particular, G'(60) and G'(80), that is, viscoelasticity at a temperature of 100° C. or less is mainly dependent upon Tg and Tm of a binder resin and a releasing agent, a coagulant, a colorant, etc. Also G'(110) and G'(160), that is viscoelasticity at a temperature of 100° C. or higher is more dependent upon internal dispersibility, a molecular weight, a degree of crosslinking, and a particle size distribution of the toner, rather than thermal properties of a binder resin or a releasing agent. Accordingly, values of G'(60), G'(80), G'(110), and G'(160) are determined as a whole by properties of a raw material, such as a binder resin, a colorant, a releasing agent, or a coagulant, used in preparing a toner, and physical characteristics of the prepared toner etc. Also, based on values of G'(80), G'(100), G'(110) and G'(160), fixing related characteristics of a toner, such as a cold offset, a minimum fixing temperature (MFT), or a fixing latitude, may be estimated.

Also, a value of [log G'(80)−log G'(100)]/20 of the toner for developing an electrostatic charge image according to an exemplary embodiment of the present general inventive concept is, for example, about 0.03 to about 0.1, for example, about 0.04 to 0.07. If the value of [log G'(60)−log G'(80)]/20 is within the above range, the toner experiences a steep decrease in a slope of the storage modulus at around a melting temperature of the binder resin and thus, when the toner is fixed or fused, the toner is sufficiently molten, thereby enabling low-temperature fixation with even a low quantity of heat during a short period of time. Thus, a stable image may be easily formed, and low-temperature and high-speed fixing of the toner is possible.

Also, a value of [log G'(110)−log G'(160)]/50 of the toner may be, for example, about 0.01 to about 0.05 or about 0.02 to about 0.04. If the value of [log G'(110)−log G'(160)]/50 is within the ranges described above, a slope of the storage modulus in a temperature range of 110 to 160° C., that is, a temperature range from low temperature to high temperature, is gentle and thus, when the toner is fixed, hot offset may be prevented and thus, flashing may not occur. Thus, high image quality, high gloss, and excellent color reproducibility may be obtained.

A value of log G'(160) of the toner may be for example, about $1.0\times10^2$ to about $3.0\times10^3$, or about $1.5\times10^2$ to about $1.5\times10^3$, or about $6.0\times10^2$ to about $1.0\times10^3$. The value of log G'(160) affects a hot offset property and a gloss property, and if the value is within the above ranges, a toner that is heated and softened in a fixing process has sufficient rubbery elasticity and thus, the toner may be easily peeled or separated from a fixing member, a hot offset on the fixing member is prevented, and the sufficient rubbery elasticity of the toner leads to appropriate adsorption of the toner on paper and thus, a gloss property may be improved. That is if viscosity is too low, that is elasticity is too low, molten toner may permeate into paper and thus a texture of paper may appear and thus an image may not be smooth and the gloss property of the image may be lowered. Accordingly, a toner needs to have an appropriate range of elasticity and viscosity, that is, a viscoelastic property.

The binder resins may have an identical or different repeating unit as long as the binder resins include two or more kinds of binder resins having different average molecular weights. The binder resins may be an addition polymer of a vinyl-based monomer, an acrylic monomer, and/or an olefin-based monomer; polyester; polyamide; or polyimide. Examples of the addition polymer are a homopolymer or copolymer of at least one polymerizable monomer selected from the group consisting of styrene-based monomers such as styrene, vinyl toluene and α-methyl styrene; acrylic acid or methacrylic acid; derivatives of (meth)acrylic acid such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylamide and methacryl amide; acrylonitrile, methacrylonitrile; ethylenically unsaturated mono-olefins such as ethylene, propylene and butylenes; halogenized vinyl monomers such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen-containing vinyl compounds such as 2-vinylpyridine, 4-vinylpyridine and N-vinyl pyrrolidone.

The polyester resin may be prepared by a reacting polyhydric alcohol with an aliphatic, a cycloaliphatic, or an aromatic polyvalent carboxylic acid, or alkyl esters thereof through direct esterification or transesterification.

If the polyester resin is a crystalline polyester resin, the crystalline polyester resin may be obtained by reacting an aliphatic polyvalent carboxylic acid having a carbon number of 8 or more (excluding carbons of carboxylic group), e.g., a carbon number of 8 to 12, specifically a carbon number of 9 to 10 with a polyhydric alcohol having a carbon number of 8 or more, e.g., a carbon number of 8 to 12, specifically a carbon number of 9 to 10. For example, the crystalline polyester resin may be a polyester resin obtained by reacting 1,9-nonanediol with 1,10-decane dicarboxilic acid, or reacting 1,9-nonanediol with 1,12-dodecanedicarboxilic acid. By limiting the carbon number in the above ranges, the crystalline polyester resin having a melting temperature appropriate for the toner may be easily obtained, and it is also easy to have affinity with the amorphous polyester resin by increasing linearity of the resin chemical structure due to its being an aliphatic polyester resin.

The preparation of the polyester resin may be performed at the polymerization temperature of about 180° C. to about 230° C. Pressure in the reaction system may be reduced as needed, and the reaction may be accelerated by removing water or alcohol generated during condensation.

When a polymerizable monomer is not dissolved or miscible at the reaction temperature, a solvent with a high boiling point may be added as a dissolution aid to dissolve the polymerizable monomer. During the polycondensation, the dissolution aid solvent may be removed by distillation. When a polymerizable monomer having poor miscibility exists in copolymerization, the polymerizable monomer having poor miscibility and an acid or an alcohol scheduled for polycondensation therewith are condensed in advance and then, the polycondesation may further be performed with the other polymerizable monomers.

If the polyester resin is an amorphous polyester resin, examples of a polyvalent carboxylic acid that is used to produce the amorphous polyester resin may include dicarboxylic acids, such as phthalic acid, isophthalic acid, terephthalic acid, tetrachlorophthalic acid, chlorophthalic acid, nitrophthalic acid, p-carboxyphenyl acetic acid, p-phenylene diacetic acid, m-phenylene diglycolic acid, p-phenylene diglycolic acid, o-phenylene diglycolic acid, dipheyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and/or cyclohexane dicarboxylic acid. Tricarboxylic acids and tetracarboxylic acids, such as trimellitic acid, pyromellitic acid, naphthalene tricarboxylic acid, naphthalene tetracarboxylic acid, pyrene tricarboxylic acid, and pyrene tetracarboxylic acid may also be used in addition to the dicarboxylic acids. Derivatives of carboxylic acids, which are derived from the above carboxylic acids, such as an acid anhydride, an acid chloride, or an ester, etc. may also be used. Among these, isophthalic acid, terephthalic acid or a lower ester thereof, and cyclohexanedicarboxylic acid may specifically be mentioned. The lower ester denotes an ester of an aliphatic alcohol having a carbon number of 1 to 8.

Also, examples of the polyhydric alcohol that is used to produce the amorphous polyester resin may include aliphatic diols such as ethylene glycol, diethylene glycol, triethylene glycol, propylene glycol, butanediol, hexanediol, neopentyl glycol, glycerine, cycloaliphatic diols such as cyclohexanediol, cyclohexane dimethanol, hydrogenated bisphenol A, aromatic diols such as an ethylene oxide addition of bisphenol A and a prophylene oxide addition of bisphenol A. One or more of these polyhydric alcohols may be used. Among these polyhydric alcohols, aromatic diols and cycloaliphatic diols may specifically be mentioned, and the aromatic diols are more frequently used. Also polyhydric alcohols having 3 or more hydroxyl groups (glycerine, trimethylolpropane, pentaerythritol) may be jointly used with diols in order to obtain a crosslinked structure or a branching structure, thereby attaining good fixability.

The amorphous polyester resin may be prepared by performing polycondensation reaction of polyhydric alcohol and polyvalent carboxylic acid according to a typical method. For example, the polyhydric alcohol and the polyvalent carboxylic acid are mixed in a reaction vessel equipped with a thermometer, a stirrer and a condenser with the addition of a catalyst if necessary. The reaction progresses by heating the mixture at about 150-250° C. in an inert gas atmosphere (nitrogen gas, etc.) with continuous removal of low molecular weight compound, such as water, produced from the reaction to the outside of the reaction system. The reaction is stopped and cooled when a predetermined acid value is achieved, thereby obtaining the amorphous polyester resin.

A catalyst that may be used for the preparation of the crystalline or amorphous polyester resins includes compounds of alkali metals such as sodium and lithium, compounds of alkaline earth metals such as magnesium and calcium, compounds of metals such as zinc, manganese, antimony, titanium, tin, zirconium, and germanium, phosphorous acid-based compounds, phosphoric acid-based compounds, and amine compounds, etc. For example, organic metals such as dibutyltin dilaurate and dibutyltin oxide, or metal alkoxide such as tetrabutyl titanate may be used. From the view point of environmental impacts or safety, titanium-based or aluminum-based catalyst is desirable. The amount of catalyst addition may be about 0.01 wt % to about 1.00 wt % based on the total weight of raw materials.

Since the releasing agent increases low-temperature fixability, excellent final image durability and abrasion resistance of the toner, types and content of the releasing agent play an important role in determining toner characteristics. The releasing agent may be a natural wax or a synthetic wax. The type of the releasing agent is not limited thereto, but may be selected from the group consisting of polyethylene-based wax, polypropylene-based wax, silicone wax, paraffin-based wax, ester-based wax, carnauba wax and a metallocene wax. A melting temperature of the releasing agent may be in the range of about 70° C. to about 100° C., for example, about 70 to about 95° C. The releasing agents physically adhere to the toner particles, but do not covalently bond with the toner particles.

An amount of the releasing agent may be, for example, about 1 to about 13 wt %, about 5 to about 13 wt %, or about 9 to about 13 wt %, based on a total weight of the toner. If the amount of the releasing agent is 1 wt % or more a low-temperature fixability of the toner is satisfactory and a fixing temperature range may be sufficiently secured. If the amount of the releasing agent is 13 wt % or less, storage ability and economy may be improved.

Regarding an oil-less fixing toner, in general, a high gloss property may be obtained by decreasing a melt viscosity of a toner. However, the melt viscosity needs to be high so as to easily peel or detach a toner from paper and suppress a hot offset. As described above, in order to obtain a paper peeling property and an anti-offset property while maintaining high gloss, a releasing agent is added to inside of a toner. That is a releasing agent dispersion is used in an, aggregation process for producing a toner. In this case, however, if an amount of the releasing agent used is too high, the excess releasing agent may contaminate a developing roll, a photoreceptor, and other components of an apparatus for forming an image such as a printer. In addition, if a releasing agent having a low melting point and low viscosity is used to perform low-temperature fixing of a toner, image quality may be low due to the presence of the releasing agent on the surface of the toner although the low-temperature fixation may be obtainable. If the melting point of the releasing agent is too low, the releasing agent is highly likely to flow out of a surface of the toner due to deterioration during a printing process, thereby causing contamination, such as filming, on a developing member. In general, a releasing agent is a crystalline polymer having a low molecular weight and its viscosity is substantially decreased at around its melting point to a level lower than the viscosity of a binder resin. A coalescing process after the aggregation process is performed generally at a temperature equal to or higher than the melting point of a releasing agent, and thus, in the coalescing process, a distribution structure of the releasing agent in a toner is flowable, and when a centrifugal force caused by stirring or agitation is applied to the releasing agent, the releasing agent migrates inside of the toner due to its low viscosity. In these circumstances, the lower the viscosity of the releasing agent such as a wax, the wider the distribution size of the releasing agent and the farther the location of the releasing agent from the surface of the toner. In order to duly provide a peelable or detachable property of the toner, which is needed to fix a toner, a distribution size and location of the releasing agent are important. For example, if the releasing agent is present too far from the surface of a toner, the releasing agent may not perform its function properly during fixing, and if the releasing agent is too close to the surface of a toner, the releasing agent may cause contamination to a developing member, thereby causing poor image quality. Accordingly, it is important to select a releasing agent that has an appropriate melting point and melt viscosity A toner according to an embodiment of the present general inventive concept includes a mixture including a paraffin-based wax and an ester group-containing ester-based synthesized wax, and due to the use of the mixed wax, the toner has an excellent detachable property and high image stability. That is, a releasing agent used in a toner according to an embodiment of the present general inventive concept may include an ester group-containing ester-based wax. Examples of such a releasing agent are (1) a mixture of an ester-based wax and a non-ester-based wax; and (2) an ester group-containing wax prepared by adding an ester group to a non-ester based wax. Since the ester group has high affinity for the binder resin latex component, especially a polyester latex components of the toner, the wax may be uniformly distributed throughout the toner particles to effectively exhibit wax effects. The non-ester-based wax components may suppress excessive plasticization that may occur when only the ester-based wax is present, due to a releasing effect of the latex. As a result, the mixture of ester-based wax and non-ester-based wax may maintain good developability of the toner for a long period of time. Specifically the mixture releasing agent of ester-based wax and non-ester-based wax may have a main endothermic peak and a secondary endothermic peak. The main endothermic peak may be in the range of about 80° C. to about 95° C., for example, about 85° C. to about 95° C., specifically about 88° C. to about 95° C., or about 89° C. to about 95° C. The secondary endothermic peak may be in the range of about 70° C. to about 80° C., for example, about 70° C. to about 78° C. or about 70° C. to about 75° C. Examples of the ester-based wax may include esters of fatty acids having a carbon number of about 15-30 with a mono- to pentavalent aliphatic alcohol, such as behenyl behenate, stearyl stearate, pentaerythritol stearate, glyceryl montanate, etc. The aliphatic alcohol component constituting the ester may be monovalent alcohol with a carbon number of about 10-30 or polyhydric alcohol with a carbon number of about 3-10. Examples of the non-ester-based wax include a polyethylene-based wax, a polypropylene-based wax, a silicone wax, and a paraffin-based wax.

Examples of the ester group-containing wax may include a mixture of a paraffin-based wax and an ester-based wax; and an ester group-containing paraffin-based wax. A specific example thereof may include P-419 and P-420 (manufactured by CHUKYO YUSHI CO., LTD.).

When the releasing agent is a mixture including a paraffin-based wax and an ester-based wax, an amount of the ester-based wax may be 10 wt % to 50 wt % based on the total weight of the paraffin-based wax and the ester-based wax, for example 15 wt % to 50 wt %, based on the total weight of the paraffin-based wax and the ester-based wax. When the amount of the ester-based wax is 10 wt % or more compatibility of the releasing agent with respect to a binder resin latex may be sufficiently maintained, and if the amount of the ester-based wax is 50 wt % or less, plasticizing characteristics of the toner are appropriately controlled and the toner retains developability for a long period of time.

In the present toner, the releasing agent may be selected such that a solubility parameter (SP) value of the binder resin has a difference of about 2 or more when compared with a SP value of the paraffin-based wax and a SP value of the ester-based wax. By selecting a combination of the binder resin and the releasing agent having such SP values, exposure of the releasing agent from the surface of the toner may be suppressed. Meanwhile, if the SP difference is small, a plasticization phenomenon may occur between the binder resin and the releasing agent. The higher the compatibility between the binder resin and the releasing agent, the smaller the distribution size of the releasing agent inside the toner may be and the nearer the releasing agent is to the surface of the toner. Also, if the compatibility is appropriate, a gloss property and an anti-offset property of the toner may be improved due to a uniform fixed or fused image and enhanced smoothness of an image. However, if the compatibility is inappropriately controlled, more of the releasing agent is exposed to the surface of the toner and contaminates other components, such as a developing roll, a photoreceptor, and other components of an apparatus for forming an image such as a printer.

The toner may have one or more endothermic peaks corresponding to melting of a releasing agent in a second heating curve obtained by differential scanning calorimetry (DSC). Among the endothermic peaks, a main endothermic peak is present in a temperature range of about 80 to about 100° C. and a secondary endothermic peak is present in a form of an independent peak or a shoulder in a temperature range of about 60 to about 80° C., and a height ratio of the endothermic peaks (main endothermic peak/secondary endothermic peak) may be 0.2 to 0.5. The main endothermic peak may be present in a temperature range of about 80° C. to about 95° C., specifically in a temperature range of about 85° C. to about 95° C. or about 88° C. to about 92° C., and more specifically in a temperature range of about 89° C. to about 91° C. The secondary endothermic peak may be present in a temperature range of about 70° C. to about 80° C., specifically in a temperature range of about 75° C. to about 80° C., and more specifically in a temperature range of about 76° C. to about 78° C. If the height ratio of the endothermic peaks is within the ranges, the paraffin-based wax and the ester-based wax may be appropriately mixed to provide the characteristics described above.

The toner for developing an electrostatic charge image according to an exemplary embodiment of the present general inventive concept may further include a coagulant including silicon (Si) and iron (Fe). When a silicon intensity and an iron intensity determined by X-ray fluorescence (XRF) measurements are denoted as [Si] and [Fe], an [Si]/[Fe] ratio of the toner may satisfy the following condition: $5\times10^{-4}\leq[Si]/[Fe]\leq5.0\times10^{-2}$. For example, the [Si]/[Fe], ratio of the silicon intensity [Si] versus the iron intensity [Fe], may be in the range of about $5.0\times10^{-4}$ to about $5.0\times10^{-2}$, specifically about $8.0\times10^{-4}$ to about $3.0\times10^{-2}$ or about $1.0\times10^{-3}$ to about $1.0\times10^{-2}$. When the [Si]/[Fe] ratio is too small, fluidity of the toner decreases because the amount of a silica external additive becomes too small, and when the ratio is too large, the inside of a printer may be contaminated because the amount of the silica external additive becomes too large.

The iron intensity [Fe] corresponds to an iron content originated from the coagulant used for aggregating a binder resin latex, a colorant, and a releasing agent during the preparation of the toner. The iron intensity [Fe] may affect ease of aggregation, particle size distribution, and size of aggregated toner particles which correspond to a precursor of the final toner. The silicon intensity [Si] is a value corresponding to a silicon content originated from the coagulant used during the preparation of the toner or from the silica external additive added to obtain fluidity of the toner. According to the silicon intensity [Si], effects of elements such as the iron, and the fluidity of the toner may be affected. The ratio of [Si]/[Fe] may be, for example, about 0.0005 to about 0.05, or about 0.0008 to about 0.03, or about 0.001 to about 0.01. If the ratio of [Si]/[Fe] is about 0.0005 to about 0.05, an amount of silica as an external additive is appropriately adjusted to improve fluidity of a toner and to prevent contamination inside a printer.

When a sulfur intensity and an iron intensity determined by X-ray fluorescence (XRF) measurements are denoted as [S] and [Fe], an [S]/[Fe] ratio of the toner for developing an electrostatic charge image according to an exemplary embodiment of the present general inventive concept may satisfy the following condition: $5\times10^{-4}\leq[S]/[Fe]\leq5.0\times10^{-2}$. The sulfur intensity [S] corresponds to an amount of sulfur contained in a chain transfer agent, which is a sulfur-containing compound and is used to control a molecular weight distribution of a binder resin latex in a process of manufacturing the binder resin latex for a toner. Accordingly, when the sulfur intensity [S] is high, the binder resin latex may have a relatively small molecular weight, and growth of a new binder resin molecular chain may be initiated. On the other hand, when the sulfur intensity [S] is low, chain growth may continue without chain transferring and thus a molecular weight of the binder resin latex may be increased If the ratio of [S]/[Fe] is within about 0.0005 to about 0.05, an aggregating property and an charging property of the toner may be improved, and toner having an appropriate molecular weight, particle size distribution, and particle size may be provided.

As described above, the toner for developing an electrostatic charge image according to an exemplary embodiment of the present general inventive concept may include Fe and Si. An amount of Fe in the toner may be, for example, about 1,000 to about 10,000 ppm, or about 2,000 to about 8,000 ppm, or about 4,000 to about 6,000 ppm. An amount of Si in the toner may be, for example, about 1,000 to about 5,000 ppm, or about 1,500 to about 4,500 ppm, or about 2,000 to about 4,000 ppm. If the amounts of Fe and Si are within the ranges described above, the charging property of the toner may be improved and contamination inside a printer may be prevented.

A volume average diameter of a toner to develop an electrostatic charge image according to an exemplary embodiment of the present general inventive concept may be in the range of about 3 μm to about 9.5 μm. For example, the diameter may be in the range of about 4 μm to about 8.5 μm, and about 4.5 μm to about 7.5 μm. Generally, although it is advantageous for obtaining high resolution and high quality for a toner particle to be smaller, it is disadvantageous at the same time in terms of transfer speed and ease of being cleaned. Therefore, it is important to have an appropriate diameter. The volume average diameter of the toner may be measured by using an electrical resistance method. When the volume average diameter of the toner is about 3.0 μm or more, photoreceptor cleaning is easy, production yield is improved, a scattering of toner particles may be suppressed, and a high resolution and high quality image may be obtained. When the volume average diameter of the toner is about 9.5 μm or less, charging is uniform, fixability of the toner is improved, and it may be easier for a doctor blade to control a toner layer.

Average circularity of the toner particles for developing an electrostatic charge image according to an exemplary embodiment of the present general inventive concept may be in the range of about 0.940 to about 0.985. For example, the average circularity may be in the range of about 0.945 to about 0.975, or about 0.950 to about 0.970. The average circularity of the toner particles may be calculated by a method that will be described below. A value of circularity is in the range of 0 and 1, and the toner particle becomes more spherically shaped as the value of circularity approaches 1. When the average circularity of the toner particles is about 0.940 or more toner consumption may be reduced because height of the image developed on a transfer member is appropriate, and sufficient coverage on the image developed on the transfer member may be obtained because voids between the toners are not extensively enlarged. When the average circularity of the toner particles is about 0.985 or less, excessive supply of the toner on a developing sleeve is prevented so that a problem of causing contamination by non-uniform coating on the sleeve with the toner may be improved.

A volume average particle size distribution index GSDv or a number average particle size distribution index GSDp as defined below may be used as an index of toner particle size distribution. A measurement method thereof will be described below. GSDv and GSDp values of toner particles for developing an electrostatic charge image according to an exemplary embodiment of the present general inventive concept may be about 1.25 or less and about 1.30 or less, respectively. The GSDv value may be about 1.25 or less, and for example, may be in the range of about 1.10 to about 1.25. The GSDp value may be about 1.30 or less, and for example, may be in the range of about 1.15 to about 1.30. If the values of the GSDv and GSDp satisfy the above ranges, a uniform particle diameter of the toner may be obtained.

The core layer of the toner particles for developing an electrostatic charge image according to an exemplary embodiment of the present general inventive concept may include a colorant. The colorant includes black colorant, cyan colorant, magenta colorant, and yellow colorant, etc.

The black colorant may be carbon black or aniline black.

The yellow colorant may be a condensation-type nitrogen compound, an isoindolinone compound, an anthraquine compound, an azo metal complex, or an allyl imide compound. In particular, C.I. pigment yellow 12, 13, 14, 17, 62, 74, 83, 93, 94, 95, 109, 110, 111, 128, 129, 147, 168, 180, or the like may be included.

The magenta colorant may be a condensation-type nitrogen compound, an anthraquine compound, a quinacridone compound, a basic dye lake compound, a naphthol compound, a benzo imidazole compound, a thioindigo compound or a perylene compound. In particular, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like may be included.

A copper phthalocyanine compound and derivatives thereof, or an anthraquine compound may be used as the cyan colorant. In particular, C.I. pigment blue 1, 7, 15, 15:1, 15:2, 15:3, 15:4, 60, 62, 66, or the like may be included.

Such colorants may be used alone or by combining to form a mixture of two or more, and are selected by considering color, chroma, luminosity, weather resistance, dispersibility in the toner, etc.

Content of the colorant may be any as long as a toner is sufficiently colored with the colorant. For example, the content of the colorant may be in the range of about 0.5 parts by weight to about 15 parts by weight, about 1 part by weight to about 12 parts by weight, or about 2 parts by weight to about 10 parts by weight based on 100 parts by weight of the toner. When the content of the colorant is about 0.5 parts by weight or more based on 100 parts by weight of the toner, sufficient coloring effect may be obtained. When the content of the colorant is about 15 parts by weight or less, a sufficient tribo-charge quantity may be provided without significantly increasing the manufacturing cost of the toner.

A toner for developing an electrostatic charge image according to an embodiment of the present general inventive concept may have a core-shell structure including a core layer and a shell layer covering the core layer. The core layer may include a binder resin, a colorant, and a releasing agent, and the shell layer may include, for example, a binder resin. The shell layer may prevent or at least suppress exposure of a colorant or a releasing agent, which exert adverse effects on charging characteristics, contained in the core layer to a surface of the toner, thereby enhancing charging stability and durability of toner particles.

The toner particles to develop an electrostatic charge image according to an exemplary embodiment of the present general inventive concept may have narrow particle size distribution in which fine particles with the diameter of less than about 3

μm are included less than about 3 wt %, and coarse particles with the diameter of about 16 μm or more are included less than about 0.5 wt %.

According to another aspect of the present general inventive concept, a method of preparing a toner to develop an electrostatic charge image is provided. The method may provide a toner having more than certain levels of high gloss, low-temperature fixation anti hot-offset property, and, heat storage ability by a combination of a low molecular weight binder resin and a high molecular weight binder resin, control of the mixing ratio thereof, and selection of a coagulant and a releasing agent.

Specifically, the method to prepare the toner to develop an electrostatic charge image includes: i) mixing a first binder resin latex, a colorant dispersion, and a releasing agent dispersion to prepare a mixture, wherein the first binder resin comprises two or more kinds of binder resins having different weight-average molecular weights; ii) adding a coagulant to the mixture to, form core layer particles comprising the first binder resin, the colorant, and the releasing agent; and iii) forming toner particles each having a core layer and a shell layer by adding a second binder resin latex to a dispersion of the core layer particles to form the shell layer comprising the second binder resin on the surfaces of the core layer particles.

A toner prepared by using the method described above includes at least a binder resin, a colorant, and a releasing agent, wherein the binder resin includes two or more kinds of binder resins having different weight-average molecular weights, and the toner has at least one endothermic peak, which is formed due to melting of the releasing agent, and the at least one endothermic peak comprises a main endothermic peak present in a temperature range of about 80° C. to about 100° C. and a secondary endothermic peak present in a form of an independent peak or a shoulder in the main endothermic peak in a temperature range of about 60° C. to about 80° C., in a second heating curve obtained by differential scanning calorimetry (DSC). The toner may have a main peak in a low molecular weight range of about 10,000 to about 30,000 g/mol and a shoulder starting point in a high molecular weight range of about 100,000 to about 300,000 g/mol, and also may have the following molecular weight distribution characteristic in a molecular weight distribution curve obtained by using a gel permeation chromatography (GPC) method on a tetrahydrofuran (THF) soluble fraction: an amount of molecules having a molecular weight greater than 5,000,000 g/mol is about 0.1 to about 1 wt % based on the total weight of the THF soluble fraction, an amount of molecules having a molecular weight in a range of 1,000,000 g/mol to 5,000,000 g/mol is about 0.5 to about 3 wt % based on the total weight of the THF soluble fraction, an amount of molecules having a molecular weight in a range of 100,000 g/mol to 500,000 g/mol is about 3 to about 10 wt % based on the total weight of the THF soluble fraction, and an amount of molecules having a molecular weight of 20,000 g/mol or less is about 45 to about 70 wt % based on the total weight of the THF soluble fraction.

First, the step i) will be described in detail. A first binder resin latex, a colorant dispersion, and a releasing agent dispersion are mixed to prepare a mixture. The first binder resin may include two or more kinds of binder resins having different weight-average molecular weights so as to control a molecular weight, Tg, and rheological characteristics of the toner. As the first binder resin, a polymer of one or more polymerizable monomers or a polyester resin may be used alone or in a combination thereof (hybrid type). If the polymer of one or more polymerizable monomers is used as the first binder resin, a releasing agent, such as wax, may be used together in a polymerization process for synthesizing the polymer or a releasing agent may be separately mixed with the polymer.

The first binder resin latex may include two or more kinds of binder resins having different weight-average molecular weights, that is, at least two kinds of binder resin latex including a low molecular weight resin latex and a high molecular weight resin latex. The high molecular weight resin may have a weight-average molecular weight of about 100,000 to about 10,000,000 g/mol, for example about 150,000 to about 600,000 g/mol. If the high molecular weight resin is within the molecular weight ranges described above, a wide fixing latitude is secured and durability and gloss properties of the toner may be improved. A weight ratio of the low molecular weight binder resin to the high molecular weight binder resin may be, for example, 99:1 to 70:30. For example, the weight ratio may be 97:3 to 80:20 or 95:5 to 85:15. If the weight ratio is within the range of 99:1 to 70:30, durability and hot offset properties of the toner may be improved and a highly glossy toner may be obtained.

The first binder resin may be prepared such that the low molecular weight binder resin latex are emulsion-polymerized or dispersed to control its volume average particle size to be in a range of about 100 to 300 nm, and the high molecular weight binder resin latex are emulsion-polymerized or dispersed to control its volume average particle size to be in a range of about 100 to about 300 nm.

If the volume average particle size of each of the low molecular weight binder resin latex and the high molecular weight binder resin latex is within about 100 to about 300 nm, a degree of aggregation of toner particles may be easily adjusted so as to provide a toner having a desired final particle size. A weight-average molecular weight of the low molecular weight binder resin may be for example, about 10,000 to about 40,000 g/mol, or about 12,000 to about 30,000 g/mol. If the low molecular weight binder resin is within the molecular weight range, the strength of the toner is improved and thus durability and fixing properties of the toner may be improved.

When the low molecular weight binder resin and the high molecular weight binder resin as a binder resin are addition polymers of one or more polymerizable monomers, examples of an available polymerizable monomer include styrene-based monomers such as styrene, vinyl toluene and α-methyl styrene; acrylic acid or methacrylic acid; derivatives of (meth)acrylic acid such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylamide and methacryl amide; acrylonitrile, methacrylonitrile; ethylenically unsaturated mono-olefins such as ethylene, propylene and butylenes; halogenized vinyl monomers such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen-containing vinyl compounds such as 2-vinylpyridine, 4-vinylpyridine and N-vinyl pyrrolidone.

When an addition polymer is used as the binder resin, a polymerizable monomer may be emulsion-polymerized in an aqueous medium including a known emulsifier to prepare a binder resin latex. In this regard, a polymerization initiator and a chain transfer agent may be used to efficiently perform the polymerization reaction.

Examples of the polymerization initiator may include persulfates such as potassium persulfate or ammonium persulfate; azo compounds such as 4,4-azobis(4-cyano valeric acid), dimethyl-2,2'-azobis(2-methylpropionate), 2,2-azobis (2-amidinopropane)dihydrochloride, 2,2-azobis-2-methyl-N-1,1-bis(hydroxymethyl)-2-hydroxyethylpropioamide, 2,2'-azobis(2,4-dimethylvaleronirile), 2,2'-azobisisobutyronirile, or 1,1'-azobis(1-cyclohexancarbonirile); and peroxides such as methyl ethyl ketone peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate, or di-t-butyl peroxyisophthalate. In addition, oxidation-reduction initiators prepared by combining these polymerization initiators and reducing agents may also be used as the polymerization initiator.

A chain transfer agent refers to a chemical compound that transfers the activity of a growing polymer chain to another molecule during a polymerization reaction. Through the use of a chain transfer agent, a degree of polymerization of polymer being synthesized may be reduced and anew growing polymer chain may be initiated. Also through the use of a chain transfer agent, a molecular weight distribution may be controlled. An amount of the chain transfer agent may be, for example, about 0.1 to about 5 parts by weight, or about 0.2 to about 3 parts by weight, or about 0.5 to about 2.0 parts by weight, based on 100 parts by weight of one or more polymerizable monomers. If the amount of the chain transfer agent is less than 0.1 parts by weight, a molecular weight of a polymer is too high and thus aggregation efficiency may be decreased, and if the amount of the chain transfer agent is higher than 5 parts by weight, a molecular weight of a polymer is too low and thus a fixing property of the toner may be decreased. Non-limiting examples of the chain transfer agent are sulfur-containing compounds such as dodecanethiol, a thioglycolic acid, a thioacetic acid, or a mercaptoethanol; halocarbons such as carbon tetrachloride; phosphorous acid compounds such as a phosphorous acid or sodium phosphite; hypophosphorous acid compounds such as hypophosphorous acid or sodium hypophosphite; and alcohols such as methyl alcohol, ethyl alcohol, isopropyl alcohol, or n-butyl alcohol.

The first binder resin latex may further include a charge control agent. The charge control agent that may be used in an exemplary embodiment of the present general inventive concept may include a negative charge-type charge control agent or a positive charge-type charge control agent. The negative charge-type charge control agent may include an organic metal complex or a chelate compound such as azo dyes containing chromium or a mono azo metal complex; a salicylic acid compound containing metal such as chromium, iron and zinc; or an organic metal complex of aromatic hydroxycarboxylic acid or aromatic dicarboxylic acid. Moreover, any known charge control agent may be used without limitation. The positive charge-type charge control agent may include nigrosine, nigrosine modified with a fatty acid metal salt and an onium salt including a quaternary ammonium salt such as tributylbenzylammonium 1-hydroxy-4-naphthosulfonate and tetrabutylammonium tetrafluoroborate, etc. These materials may be used alone or in a combination of at least two. Since the charge control agent stably supports the toner on a developing roller by electrostatic force, charging may be performed stably and quickly using the charge control agent.

If polyester is used as the binder resin, a phase inversion emulsification method may be used to produce a polyester latex. For this purpose, a polyester organic solution is first prepared by dissolving the polyester resin in an organic solvent. The organic solvent may be a solvent known in the art, but typically, a ketone solvent such as acetone and methyl ethyl ketone, an aliphatic alcohol solvent such as methanol, ethanol, and isopropanol, or combinations thereof may be used. Subsequently, NaOH, KOH, or ammonium hydroxide aqueous solution are added into the organic solution and stirred. At this time the added amount of the basic compound is determined so that it will react with the amount of carboxylic groups present in the polyester resin which may be calculated from an acid value of the polyester resin in an equivalent weight basis. A large amount of water is added into the polyester resin organic solution to perform phase inversion emulsification which converts the organic solution into an oil-in-water emulsion. At this time, a surfactant may be further included selectively. The polyester resin latex may be obtained by removing the organic solvent from the obtained emulsion by using a method such as vacuum distillation, etc. As a result, for example, resin latex (emulsion) including polyester resin particles having an average particle diameter of about 1 μm or less, about 100 nm to about 300 nm, and about 150 nm to about 250 nm is obtained.

A solid content of the binder resin latex is not particularly limited, but this may be in the range of about 5 wt % to about 40 wt %, for example, about 15 wt % to about 30 wt %. A low molecular weight binder resin latex and a high molecular weight binder resin latex each prepared as described above are mixed at a ratio of 99:1 to 70:30 to prepare the first binder resin latex that functions as a binder resin for the core layer. Alternatively, the low molecular weight binder resin latex and the high molecular weight binder resin latex may not be mixed in advance, but individually mixed as a portion of the first binder resin latex together with a colorant dispersion and a releasing agent dispersion, etc.

The first binder resin latex thus prepared is mixed with a colorant dispersion and a releasing agent dispersion to prepare a mixture.

The colorant dispersion may be prepared by homogeneously dispersing a composition including colorants such as black, cyan, magenta and yellow and an emulsifier using an ultrasonic homogenizer, micro fluidizer and the like. Types and contents of colorants that may be used are as described above. Such colorants may be used alone or by combining to form a mixture of two or more, and are selected by considering color, chroma, luminosity (brightness), weather resistance, dispersibility in the toner, etc. Any emulsifier that is known in art may be used as an emulsifier used when preparing the colorant dispersion. For example, an anionic reactive emulsifier, a non-ionic reactive emulsifier or a mixture thereof may be used. A specific example of the anionic reactive emulsifier may include HS-10 (Dai-ichi Kogyo, Co., Ltd.) and Dowfax 2A1 (Rhodia Inc.), etc. A specific example of the non-ionic reactive emulsifier may include RN-10 (Dai-ichi Kogyo, Co., Ltd.).

The releasing agent dispersion includes a releasing agent, water, and an emulsifier. Types and contents of emulsifiers that may be used are as described above. The emulsifier included in the releasing agent dispersion may be an emulsifier that is known in the art like the emulsifier used in the colorant dispersion.

The mixture is prepared by mixing the first binder resin latex, colorant dispersion and releasing agent dispersion, which are obtained as described above. An apparatus such as homomixer and homogenizer may be used during preparation of the mixture.

Subsequently, a coagulant is added to the mixture to form core layer particles including the first binder resin, the colorant, and the releasing agent. In detail, after the first binder resin latex, the colorant dispersion, and the releasing agent dispersion are mixed, a coagulant is added thereto at a pH of about 0.1 to about 4.0, for example, about 1.0 to about 2.0 to form toner particulates having a volume average particle size of about 2.5 μm or less. In detail, a pH of the mixture is adjusted to be about 0.1 to about 4.0 and then, a coagulant is added to the mixture at a temperature equal to or lower than the Tg of the binder resin, for example, about 25 to about 70° C., or about 35 to about 60° C., and then a shear-induced aggregation mechanism is performed thereon by using a homogenizer, etc. to generate a primary aggregated toner. Then, fixing is performed thereon at a temperature of about 30 to about 50° C. higher than the Tg of the binder resin to form core layer particles, for example, having a volume average particle size of about 4.5 μm to about 6.5 μm.

Then, in order to form a shell layer including a second binder resin on a surface of each core layer particle, a second binder resin latex is added to a reaction vessel and a pH inside the system is controlled to be about 6 to about 9, for example about 6 to about 8. When a particle size is maintained constant for a predetermined time period, the temperature is increased to about 85 to about 100° C., for example, about 90 to about 98° C. and the pH is decreased to about 5 to about 6 to perform a coalescence process to produce toner particles.

Examples of the coagulant are NaCl, $MgCl_2$, $MgCl_2.8H_2O$, ferrous sulfate, ferric sulfate, ferric chloride, calcium hydroxide, calcium carbonate, and metallic salts containing silicon (Si) and iron (Fe). However, the coagulant is not limited to these examples. An amount of the coagulant may be for example, about 0.1 to about 10 parts by weight, or 0.5 to 8 parts by weight, or 1 to 6 parts by weight, based on 100 parts by weight of the first binder resin particles. If the amount of the coagulant is less than 0.1 parts by weight, aggregation efficiency may be decreased, and if the amount of the coagulant is greater than 10 parts by weight, a charging property of the toner may be degraded and a particle size distribution may be deteriorated.

Specifically, a toner for developing an electrostatic charge image may be manufactured by using a metallic salt containing silicon (Si) and iron (Fe) as a coagulant. In this case, the prepared toner may include about 1,000 to about 10,000 ppm of Fe and about 1,000 to about 5,000 ppm of Si. If the amounts of Si and Fe are too low, an effect of adding the coagulant may be negligible. On the other hand, if the amounts of Si and Fe are too high, a charging property of the toner may be degraded and an interior of an apparatus for forming an image, such as a printer, may be contaminated.

In particular, when the metallic salts containing Si and Fe are used the size of the primary aggregated toner particles will be increased by increased ionic strength and collisions between particles. For example, the metallic salts containing Si and Fe may include polysilicate iron or "Polysilicato-Iron", and particularly, may use PSI-025, PSI-050, PSI-085, PSI-100, PSI-200, and PSI-300 (product names, SUIDO KIKO KAISHA LTD.). PSI is an abbreviation of "Polysilicato-Iron". Physical properties and compositions thereof are listed in Table 1 below. The metal salts containing Si and Fe exhibit a strong aggregation force even at a lower temperature, environmental stability, uniform control for a particle size and shape of aggregated toner particles and a smaller amount of coagulant may be used as compared to the coagulants used in a typical emulsion-aggregation (EA) method. Above all, since these metal salts use iron and silica as main components, effects of residual aluminum on the environment and the human body, which is limitation of typical trivalent aluminum polymer coagulants, may be minimized.

TABLE 1

| | | Type | | | | | |
|---|---|---|---|---|---|---|---|
| | | PSI-025 | PSI-050 | PSI-085 | PSI-100 | PSI-200 | PSI-300 |
| Si/Fe mole ratio | | 0.25 | 0.5 | 0.85 | 1 | 2 | 3 |
| Main component concentration | Fe (wt %) | 5.0 | 3.5 | 2.5 | 2.0 | 1.0 | 0.7 |
| | $SiO_2$ (wt %) | 1.4 | 1.9 | 2.0 | | 2.2 | |
| pH (1 w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or more | | | | | |
| Average molecular weight (g/mol) | | about 500,000 | | | | | |
| Appearance | | Yellowish brown transparent liquid | | | | | |

The use of a metallic salt containing Si and Fe as a coagulant in the preparation process for a toner enables production of small particles and a control of a particle shape. A pH of a coagulant solution may be, for example, about 2.0 or less, or for example, about 0.1 to about 2.0. If the pH of the coagulant solution is less than 0.1, the coagulant solution is too acidic and thus handling of the coagulant solution is not easy. On the other hand, if the pH of the coagulant solution is higher than 2.0, Fe, which is contained in the coagulant, may not control the odor of a chain transfer agent used in preparing a binder resin latex, that is, a sulfur-containing compound, and aggregation efficiency may be decreased.

The second binder resin latex may be identical to the first binder resin latex. Accordingly, all the description presented regarding the first binder resin latex may be applied to the second binder resin latex. A mixed ratio of the low molecular weight to the high molecular weight binder resin latex in the second binder resin latex may be identical or different from a mixed ratio of the low molecular weight to the high molecular weight binder resin latex in the first binder resin latex.

The steps of adding a coagulant to the mixture and forming toner particles includes:

a) aggregating the core layer particles and shell layer particles by adding the coagulant and the second binder resin latex sequentially, and adhering the shell layer particles on the surfaces of the core layer particles in such a temperature range that a shear storage modulus (G') of each of the core layer particle and the shell layer particle is about $1.0\times10^8$ to about $1.0\times10^9$ Pa;

b) stopping the aggregating reaction when an average size of particles formed in step a) is about 70 to about 100% of an average target size of the final toner particles; and c) coalescing the particles in step b) to obtain toner particles in such a temperature range that a shear storage modulus (G') of the particles in step b) is about $1.0\times10^4$ to about $1.0\times10^9$ Pa.

In the step a) for aggregating the core layer particle and the shell layer particle, physical aggregating is performed. Accordingly, by performing the step a) in such a temperature range that a shear storage modulus (G') of each of the core layer particle and the shell layer particle is $1.0\times10^8$ to $1.0\times10^9$ Pa, fusing of the core layer particle and the shell layer particle in advance may be prevented so as to efficiently control a toner particle size distribution.

In the step c) for coalescing the particles formed in step b) to obtain final toner particles prior to adding external additives, heating is performed in such a temperature range a shear storage modulus (G') of the obtained particles in step b) is $1.0\times10^4$ to $1.0\times10^9$ Pa, that is a temperature range of about 10° C. to about 30° C. higher than a melting point of the particles formed in step b). That is, the second binder resin latex that functions as a shell layer is added to the core layer particles, a pH of the reaction system is adjusted to be about 6 to about 9, and when a particle size is maintained constant for a predetermined period of time the temperature is increased to a range of about 85 to about 100° C., for example, about 90 to about 98° C., and the pH is lowered to about 5 to about 6 to the particles formed in step b), thereby completing preparation of toner particles.

Meanwhile, the toner particles may be additionally coated with a third binder resin latex including a polymer of one or more polymerizable monomers as described above and/or polyester. The third binder resin latex may be identical to the first binder resin latex. Accordingly, all the description presented regarding the first binder resin latex may be applied to the third binder resin latex. A mixed ratio of the low molecular weight to the high molecular weight binder resin latex in the third binder resin latex may be identical or different from a mixed ratio of the low molecular weight to the high molecular weight binder resin latex in the first binder resin latex.

By forming a shell layer using the second binder resin or the second binder resin and the third binder resin, durability of a toner is increased and storage ability of a toner during shipping and handling may be improved. In this regard, a polymerization inhibitor for preventing formation of new binder resin particles may be additionally added thereto, and the formation process may be performed under starved-feeding conditions so as to sufficiently coat toner particles with a mixture of polymerizable monomers.

The obtained toner particles are filtered, separated, and dried. An external additive may be externally added to the dried toner particles and a charge quantity, etc. is adjusted, thereby producing a final dry toner.

The external additive may be a silicon-containing particle or a titanium-containing particle. The silicon-containing particle may include a large-size silicon-containing particle having a volume average particle size of about 30 to about 100 nm and a small-size silicon-containing particle having a volume average particle size of about 5 to about 20 nm. The silicon-containing particle may be silica, but is not limited thereto. The small-size silicon-containing particle and the large-size silicon-containing particle are added to provide a property of being negatively-charged and good fluidity to toner particles, and may be prepared from halogenated silicon through a drying method or from a silicon compound through a wet method in which silica particles are precipitated in a liquid medium. The large-size silicon-containing particle may have a volume average particle size of about 30 to about 100 nm, and may facilitate separation characteristics between toner mother particles in which the toner mother particle refers to a toner to which an external additive is not externally added. The small-size silicon-containing particle may have a volume average particle size of about 5 to about 20 nm and may provide good fluidity to toner particles. An amount of the large-size silicon-containing particle may be, for example, about 0.1 to about 3.5 parts by weight, or about 0.5 to about 3.0 parts by weight, or about 1.0 to about 2.5 parts by weight, based on 100 parts by weight of the toner mother particle. If the amount of the large-size silicon-containing particle is within about 0.1 to about 3.5 parts by weight, a fixing property of the toner may be improved, and over-charging and contamination, and filming may be prevented or suppressed. An amount of the small-size silicon-containing particle may be, for example, about 0.1 to about 2.0 parts by weight, or about 0.3 to about 1.5 parts by weight, or about 0.5 to about 1.0 parts by weight, based on 100 parts by weight of the toner mother particle. If the amount of the small-size silicon-containing particle is within about 0.1 to about 2.0 parts by weight, a fixing property of the toner may be improved and over-charging and poor cleaning may be prevented or suppressed.

An example of the titanium-containing particle may be titanium dioxide, but is not limited thereto. The titanium-containing particle may increase a charging amount and may have excellent environmental characteristics. In particular, a problem of charge-up occurring at low temperature and in low humidity may be prevented or suppressed, and a problem of charge-down occurring at high temperature and in high humidity may be prevented or suppressed. In addition, the titanium-containing particle may improve fluidity of toner, and due to the titanium-containing particle, high transfer efficiency may be sustained even when producing large amounts of printed materials for a longer period of time. A volume average particle size of the titanium-containing particle may be about 10 to about 200 nm. An amount of the titanium-containing particle may be for example, about 0.1 to about 2.0 parts by weight, or about 0.3 to about 1.5 parts by weight, or about 0.5 to about 1.0 parts by weight, based on 100 parts by weight of the toner mother particle. If the amount of the titanium-containing particle is within about 0.1 to about 2.0 parts by weight, a charging maintenance property with respect to environmental conditions may be improved, and image staining and a decrease in charging amount may be prevented.

According to another aspect of the present general inventive concept, provided is a method of forming an image including adhering a toner to a surface of an image carrier on which an electrostatic latent image is formed to form a visible image and transferring the visible image to an image receiving member, wherein the toner is a toner for developing an electrostatic charge image according to the present general inventive concept.

An electrophotographic image forming process includes a series of steps including the steps of charging, image-wise exposure to light, developing, transferring, fixing, cleaning and erasure to form an image on an image receiving member.

In the charging step, a surface of an image carrier such as photoreceptor is charged with one of desired polarities, i.e., negative or positive charge, by a corona charging device or a charge roller. In the exposing step, an optical system, conventionally a laser scanner or an array of diodes, forms a latent image by selectively discharging the charged surface of the image carrier in an imagewise manner corresponding to a target image formed on a final image receiving member. Electromagnetic radiation, originated from the laser scanner or array of diodes and referred to as "light", may include infrared irradiation, visible light irradiation, or ultraviolet irradiation.

In the developing step, toner particles with appropriate polarity generally contact the latent image on the image carrier, and conventionally, an electrically-biased developer having identical potential polarity to the toner polarity is used. The toner particles move to the image carrier and selectively adhere to the latent image by electrostatic force to form a toner image on the image carrier.

In the transferring step, the toner image is transferred to the final image receiving member from the image carrier. An intermediate transferring member which receives the toner image from the image carrier and subsequently transfers it to the final image receiving member is sometimes used.

In the fixing step, the toner particles are softened or melted by heating the toner image on the final image receiving member, thereby fixing the toner image to the final image receiving member. Another fixing method is to fix the toner on the final image receiving member under high pressure with or without application of heat.

In the cleaning step, residual toner remaining on the image carrier is removed.

Finally, in the erasure step, charges of the image carrier are exposed to light of a specific wavelength band and are reduced to a substantially uniform low value. Therefore, a residue of the latent image is removed and the image carrier is prepared for a next image forming cycle.

According to another aspect of the present general inventive concept, provided is a toner supply device including: a toner tank storing a toner; a supplying part protruding toward an inner side of the toner tank and supplying the stored toner to outside; and a toner stirring member rotatably installed inside the toner tank and configured to stir the toner in almost an entire inner space of the toner tank including an upper portion of the supplying part, wherein the toner is for developing an electrostatic charge image according to the another aspect of the present general inventive concept.

Figure 2:
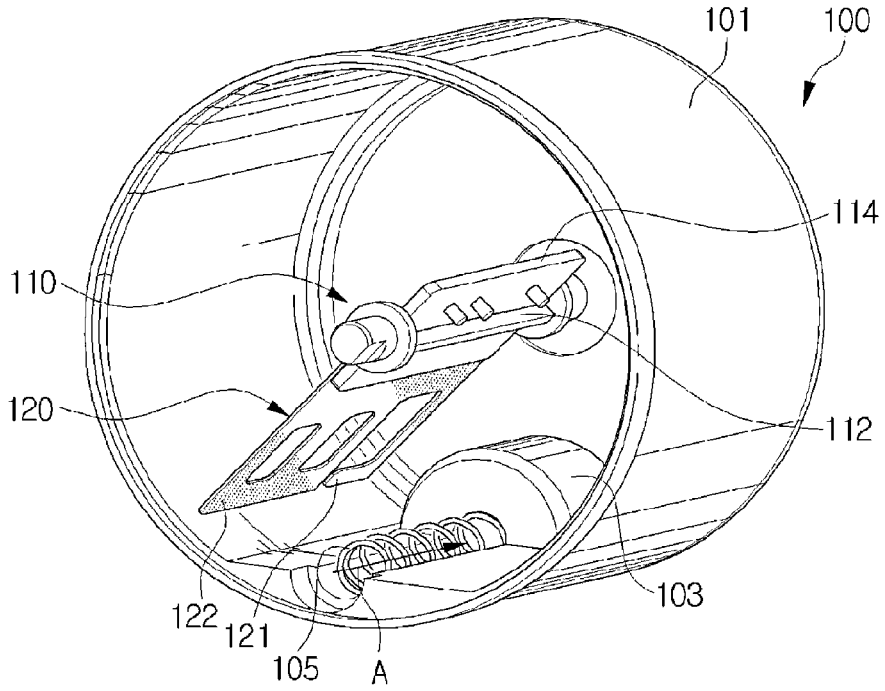
FIG. 2 is a perspective view of a toner supply device according to an exemplary embodiment of the present general inventive concept.

FIG. 2 is a perspective view of a toner supply device 100 according to an exemplary embodiment of the present general inventive concept. Referring to FIG. 2, the toner supplying apparatus 100 includes a toner tank 101, a supplying part 103, a toner conveying member 105, and a toner stirring member 110.

The toner tank 101 stores a predetermined amount of toner and is generally formed in a hollow cylindrical shape.

The supplying part 103 is installed at an inner lower part of the toner tank 101 and discharges the toner stored in the toner tank 101 to the outside of the toner tank 101. That is, the supplying part 103 may protrude from a bottom of the toner tank 101 to the inside of the toner tank 101 in a pillar shape having a semi-circular section. The supplying part 103 includes a toner outlet (not shown) to discharge the toner to an outer surface thereof.

The toner conveying member 105 is installed at a side of the supplying part 103 at the inner lower part of the inside of the toner tank 101. The toner conveying member 105 is formed in a coil spring shape. Since an end of the toner conveying member 105 extends to an inner side of the supplying part 103, the toner in the toner tank 101 is conveyed to the inner side of the supplying part 103 when the toner conveying member 105 rotates. The toner conveyed by the toner conveying member 105 is discharged to the outside through the toner outlet.

The toner stirring member 110 is rotatably installed inside the toner tank 101 and forces the toner in the toner tank 101 to move in a radial direction. That is when the toner stirring member 110 rotates at a middle of the toner tank 101, the toner in the toner tank 101 is stirred to prevent the toner from solidifying. Then, the toner moves down to the bottom of the toner tank 101 by its own weight. The toner stirring member 110 includes a rotation shaft 112 and a toner stirring film 120. The rotation shaft 112 is rotatably installed at the middle of the toner tank 101 and has a driving gear (not shown) coaxially installed at an end of the rotation shaft 112 protruding toward a side of the toner tank 101. Therefore, the driving gear and the rotation shaft 112 may rotate as one unit. Also, the rotation shaft 112 may have a wing plate 114 to help fix the toner stirring film 120 to the rotation shaft 112. In general, the wing plate 114 may be symmetrically formed about the rotation shaft 112.

The toner stirring film 120 has a width corresponding to the inner length of the toner tank 101, and may be elastically deformed along a protrusion at an inner side of the toner tank 101, i.e., the supplying part 103. Portions of the toner stirring film 120 may be cut off from an end of the toner stirring film 120 toward the rotation shaft 112 to form a first stirring part 121 and a second stirring part 122.

Figure 3:
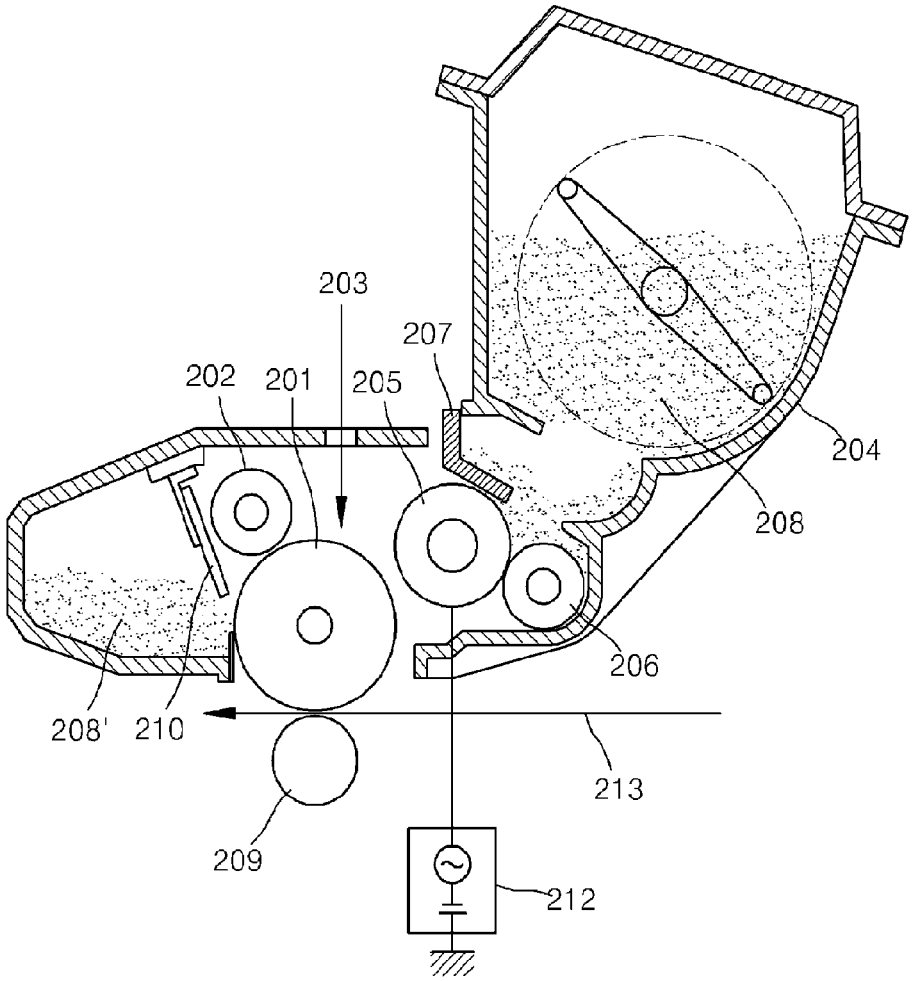
FIG. 3 is an example of an apparatus for forming an image containing a toner prepared according to an exemplary embodiment of the present general inventive concept.

FIG. 3 is a view illustrating an example of a non-contact development type apparatus for forming an image including a toner according to another aspect of the present general inventive concept, and an operating principle thereof will be described below.

A nonmagnetic one-component developer, i.e., a toner 208 in a developing device 204, is supplied on a developing roller 205 by a supplying roller 206 formed of an elastic material, such as polyurethane foam or sponge, etc. The toner 208 supplied on the developing roller 205 reaches a contact portion between a developer controlling blade 207 and the developing roller 205 according to the rotation of the developing roller 205. The developer controlling blade 207 may be formed of an elastic material, such as metal or rubber, etc. When the toner 208 passes through the contact portion between the developer controlling blade 207 and the developing roller 205, the toner 208 is controlled and formed into a thin layer having uniform thickness, and may be sufficiently charged. The thin-layered toner 208 is transferred to a development region in which the toner 208 is developed on a latent image of a photoreceptor 201, which is an example of an image carrier, by the developing roller 205. At this time, the latent image is formed by scanning light 203 to the photoreceptor 201.

The developing roller 205 is separated from the photoreceptor 201 by a predetermined distance and faces the photoreceptor 201. The developing roller 205 rotates in a counterclockwise direction, and the photoreceptor 201 rotates in a clockwise direction.

The toner 208, which has been transferred to the development region of the photoreceptor 201, develops the latent image formed on the photoreceptor 201 by an electric force generated by a potential difference between a direct current (DC) biased alternating current (AC) voltage applied by a power source 212 to the developing roller 205 and a potential of the latent image on the photoreceptor 201 charged by a charging device 202. As a result, the toner 208 may form a toner image.

The toner 208 developed on the photoreceptor 201 reaches a position of a transfer device 209 according to the rotation direction of the photoreceptor 201. An image is formed by transferring the toner 208 developed on the photoreceptor to a printing medium 213, i.e., an image receiving member, by corona discharging or the transfer device 209 having a roller shape to which high voltage with a polarity opposite to the toner 208 is applied, while the printing paper 213 passes between the photoreceptor 201 and the transfer device 209.

The image transferred to the printing medium 213 passes through a high-temperature and high-pressure fixing device (not shown) and the image is fixed by fusing the toner 208 to the printing paper. Meanwhile, a non-developed residual toner 208' on the developing roller 205 is collected by the supplying roller 206 in contact with the developing roller 205, and the non-developed residual toner 208' on the photoreceptor 201 is collected by a cleaning blade 210. The processes described above are repeatedly performed.

The present inventive concept will now be described in further detail with reference to the following examples. These examples are for illustrative purposes only and are not intended to limit the scope of the present inventive concept.

Manufacturing Example 1

Synthesis of Low Molecular Weight Resin Latex (L-LTX)

A polymerizable monomer mixture (825 g of styrene, 175 g of n-butyl acrylate), 30 g of 2-carboxyethylacrylate (Sipomer, Rhodia), 25 g of 1-dodecanethiol acting as a chain transfer agent (CTA), and 418 g of sodium dodecyl sulfate (Aldrich) aqueous solution (2 wt % based on the weight of water) as an emulsifier were loaded into a 3 L beaker, and the mixture was stirred to prepare a polymerizable monomer-emulsified solution. Separately, 16 g of ammonium persulfate (APS) as an initiator and 696 g of sodium dodecyl sulfate (Aldrich) aqueous solution (0.4 wt % based on the weight of water) as an emulsifier were loaded into a 3 L double-jacketed reactor heated to a temperature of about 75° C. and the polymerizable monomer-emulsified solution separately prepared as described above was slowly added thereto dropwise while stirring for 2 hours or more, thereby producing a low molecular weight resin latex (L-LTX). The reaction was performed for 8 hours at a reaction temperature of about 75° C. An average particle size of the prepared low molecular weight resin latex (L-LTX) was measured by using a light scattering type particle size analyzer (Microtrac Company, model name: Microtrac S3500 Particle Analyzer), and the measured average particle size was about 180 to about 250 nm. A solid content of the latex measured by using a loss-on-drying method was about 42 wt %. A weight-average molecular weight (Mw) of the latex measured by using a gel permeation chromatography (GPC) method on a tetrahydrofuran (THF) soluble fraction was about 25,000 g/mol. A glass transition temperature of the latex measured by using a differential scanning calorimeter (PerkinElmer Company, model name: DSC-6) in a second heating curve at a heating rate of 10° C./min was about 62° C.

Manufacturing Example 2

Synthesis of High Molecular Weight Resin Latex (H-LTX)

Polymerizable monomer mixture (685 g of styrene, 315 g of n-butyl acrylate), 30 g of 2-carboxyethylacrylate (Sipomer, Rhodia), and 418 g of sodium dodecyl sulfate (Aldrich) aqueous solution (2 wt % based on the weight of water) were loaded into a 3 L beaker, and the mixture was stirred to prepare a polymerizable monomer-emulsified solution. Separately, 5 g of ammonium persulfate (APS) as an initiator and 696 g of sodium dodecyl sulfate (Aldrich) aqueous solution (0.4 wt % based on the weight of water) were loaded into a 3 L double-jacketed reactor heated to a temperature of about 60° C. and the polymerizable monomer-emulsified solution separately prepared as described above was slowly added thereto dropwise while stirring for 3 hours or more, thereby producing a high molecular weight resin latex (H-LTX). The reaction was performed for 8 hours at a reaction temperature of about 75° C. An average particle size of the prepared high molecular weight resin latex (H-LTX) was measured by using a light scattering type particle size analyzer (Microtrac Company, model name: Microtrac S3500 Particle Analyzer), and the measured average particle size was about 180 to about 250 nm. A solid content of the latex measured by using a loss-on-drying method was about 42 wt %. A weight-average molecular weight (Mw) of the latex measured by using a GPC method on a THF soluble fraction was about 250,000 g/mol. A glass transition temperature of the latex measured by using a differential scanning calorimeter (PerkinElmer Company, model name: DSC-6) in a second heating curve at a heating rate of 10° C./min was about 53° C.

Manufacturing Example 3

Preparation of Colorant Dispersion 10 g of sodium dodecyl sulfate (Aldrich) as an anionic reactive emulsifier was loaded into a milling bath together with 60 g of cyan pigment (PB 15:4), and 400 g of glass beads having a diameter of about 0.8 to about 1 mm were added thereto and milling was performed thereon at room temperature. Then, pigment dispersion was further performed by using an ultrasonic wavelength disperser (Sonic & Materials, VCX750) to prepare a colorant dispersion. A pigment dispersion diameter was measured by using a light scattering type particle size analyzer (Microtrac S3500) and the result was about 180 to about 200 nm. A solid content of the prepared colorant dispersion was about 18.5 wt %.

Manufacturing Example 4

Releasing Agent Dispersion

Regarding Examples 1-3 below, P-419 and P-420, which were obtained from CHUKYO YUSHI CO., LTD., were used as a releasing agent dispersion. The releasing agent dispersions are dispersions of a mixture including a paraffin-based wax and an ester-based wax so as to be compatible with a binder resin and have a high melting temperature as shown in Table 2 by high Tm1 and Tm2. Wax dispersions used in Comparative Examples 1-6 below were a paraffin-based wax, or an ester-based wax, or a mixture including a paraffin-based wax and an ester-based wax but have a lower melting temperature as shown in Table 2 by lower Tm1 and Tm2 that can be commercially available under the indicated trademark or grade name. Table 2 below shows compositions and properties of wax dispersions used in Examples 1-3 and Comparative Examples 1-6.

TABLE 2

| Wax Dispersion | Paraffin Content (wt %) | Ester Content (wt %) | Tm1 (° C.) | Tm2 (° C.) | Remarks |
|---|---|---|---|---|---|
| P-419* | 50-70 wt % | 30-50 wt % | 89.8 | 73.5 | doublet |
| P-420* | 70-85 wt % | 15-30 wt % | 89.4 | 72.7 | |
| P-212* | 50-70 wt % | 30-50 wt % | 72.9 | 69.3 | doublet |
| HNP-9* | 100 wt % | 0 | 78.8 | — | |
| Q-908* | 100 wt % | 0 | 79.1 | — | |
| FNP-090* | 100 wt % | 0 | 92.6 | — | |
| WE-5* | 0 | 100 wt % | 76.7 | 83.7 | |

*available from CHUKYO YUSHI CO., LTD.

In Table 2, Tm1 and Tm2 respectively represent a main endothermic peak temperature and a secondary endothermic peak temperature. The main endothermic peak temperature Tm1 and the secondary endothermic peak temperature Tm2 are each defined as a temperature at which the peak of the corresponding endothermic curve is present. The temperatures were measured by using a differential scanning calorimeter under the following conditions according to ASTM D3418-8 test method: a sample was heated in a nitrogen gas atmosphere from room temperature to 140° C. at a heating rate of 20° C./min (first heating), and the temperature of 140° C. was maintained for 1 minute and then decreased from 140° C. to 0° C. at a cooling rate of 20° C./min. Then, the sample was heated from 0° C. to 140° C. at a heating rate of 10° C./min (second heating) and a temperature at which an endothermic peak due to melting of a crystalline region appears was measured. Respective measurement values are obtained from a second heating curve.

Example 1

Preparation of Aggregated Toner 3,000 g of deionized water, 1,137 g of a mixture including 95 wt % of the low molecular weight resin latex L-LTX synthesized according to Manufacturing Example 1 and 5 wt % of the high molecular weight resin latex H-LTX synthesized according to Manufacturing Example 2 as a first binder resin latex, 195 g of the cyan pigment dispersion, and 237 g of P-419 (about 30.5 wt % of solid content) as a wax dispersion were loaded into a 7 L reactor. 364 g of nitric acid concentration of 0.3M), and 182 g of PSI-100 (SUIDO KIKO KAISHA LTD.) as a coagulant were added to the mixture and stirred by using a homogenizer at a rotational rate of 11,000 rpm for 6 minutes, to prepare core layer particles having a volume average particle size of about 1.5 to about 2.5 μm. The resultant mixture was loaded into a 7 L double-jacketed reactor and the temperature was increased from room temperature to about 55° C. at a heating rate of 0.5° C./minute. When the average particle size reached about 6.0 μm, 442 g of a latex mixture (a mixture including 90 wt % of the L-LTX and 10 wt % of the H-LTX) was slowly added thereto for 20 minutes, and when a volume average particle size reached about 6.8 μm, a NaOH aqueous solution was added thereto to control a pH to be about 7. When the volume average particle size was maintained constant for 10 minutes, the temperature was increased to about 96° C. (at a heating rate of 0.5° C./min). When the temperature reached about 96° C., nitric acid was added to control a pH to be about 6.0 to coalesce particles for about 3 to about 5 hours, thereby producing a second aggregated toner having a potato-shape having a volume average particle size of about 6.5 to about 7.0 μm. Then, the resultant aggregated reaction solution was cooled to room temperature and filtered to isolate toner particles, and the toner particles were dried.

External additives were added to the toner particles by adding about 100 g of the dried toner, particles, about 0.5 g of NX-90 (NIPPON AEROSIL), about 0.1 g of Rx-200 (NIPPON AEROSIL), and about 0.5 g of SW-100 (TITAN KOGYO) in a mixer (KM-LS2K, DAE WHA TECH.), and stirring the toner particles and the external additives at about 8,000 rpm for about 4 minutes. As a result, toner having the volume average particle size of about 6.5 to about 7.0 μm was obtained. Values of GSDp and GSDv of the toner particles were about 1.282 and about 1.217, respectively. Also, average circularity of the toner was about 0.971.

Example 2

A toner was prepared in the same manner as in Example 1, except that 237 g of P-420 (CHUKYO YUSHI CO., LTD.) was used instead of P-419 as a wax dispersion. GSDp and GSDv of the toner were about 1.268 and about 1.223, respectively. The circularity of the toner was about 0.974.

Example 3

A toner was prepared in the same manner as in Example 1, except that 342 g of P-420 (CHUKYO YUSHI CO., LTD.) was used instead of P-419 as a wax dispersion. GSDp and GSDv of the toner were about 1.271 and about 1.219, respectively. The circularity of the toner was about 0.974.

Comparative Example 1

A toner was prepared in the same manner as in Example 1, except that 237 g of P-212 (CHUKYO YUSHI CO., LTD.) was used instead of P-419 as a wax dispersion. GSDp and GSDv of the toner were about 1.265 and about 1.244, respectively. The circularity of the toner was about 0.977.

Comparative Example 2

A toner was prepared in the same manner as in Example 1, except that 237 g of HNP-9 (CHUKYO YUSHI CO., LTD.) was used instead of P-419 as a wax dispersion. GSDp and GSDv of the toner were about 1.267 and about 1.220, respectively. The circularity of the toner was about 0.973.

Comparative Example 3

A toner was prepared in the same manner as in Example 1, except that 237 g of Q-908 dispersion (CHUKYO YUSHI CO., LTD.) was used instead of P-419 as a wax dispersion. GSDp and GSDv of the toner were about 1.270 and about 1.228, respectively. The circularity of the toner was about 0.971.

Comparative Example 4

A toner was prepared in the same manner as in Example 1, except that 237 g of FNP-090 dispersion (CHUKYO YUSHI CO., LTD.) was used instead of P-419 as a wax dispersion. GSDp and GSDv of the toner were about 1.270 and about 1.228, respectively. The circularity of the toner was about 0.973.

Comparative Example 5

A toner was prepared in the same manner as in Example 1, except that 237 g of WE-5 dispersion (CHUKYO YUSHI CO., LTD.) was used instead of P-419 as a wax dispersion. GSDp and GSDv of the toner were about 1.270 and about 1.228, respectively. The circularity of the toner was about 0.973.

Comparative Example 6

A toner was prepared in the same manner as in Example 1, except that 394.5 g of P-420 (CHUKYO YUSHI CO., LTD.) was used instead of P-419 as a wax dispersion. GSDp and GSDv of the toner were about 1.266 and about 1.225, respectively. The circularity of the toner was about 0.973.

A main peak of each of the toners prepared according to Examples 1-3 and Comparative Examples 1-6 appeared at a molecular weight of about 23,000 g/mol, a shoulder starting point of each of the toners was at a molecular weight of about 200,000 g/mol, a weight-average molecular weight of each of the toners was about 100,000 g/mol, and a z-average molecular weight (Mz) of each of the toners was about 6,000,000 g/mol. Tg, which was measured, according to ASTM D3418-8 methodology, in a second heating curve obtained by differential scanning calorimetry (DSC) of each of the toners, was about 56° C., and a temperature at which a shear storage modulus began to decrease from a shear storage modulus (G') curve obtained by ARES, that is, on-set temperature Ts, was about 55.2° C. Table 3 below shows some thermal properties of the toners prepared according to Examples 1-3 and Comparative Examples 1-6 measured by using evaluation methods described below.

TABLE 3

| | Wax dispersion used | Tm1 (° C.) | Tm2 (° C.) | Height ratio of secondary endothermic peak/main endothermic peak | ΔH(J/g)* |
|---|---|---|---|---|---|
| Example 1 | P-419 | 90.7 | 76.9 | 0.5 | 14.9 |
| Example 2 | P-420 | 89.7 | 77.4 | 0.2 | 15.8 |
| Example 3 | P-420 | 89.1 | 77.4 | 0.2 | 23.1 |
| Comparative Example 1 | P-212 | 73.3 | 68.5 | 0.8 | 14.3 |
| Comparative Example 2 | HNP-9 | 75.5 | 70.7 | 0.3 | 17.5 |
| Comparative Example 3 | Q-908 | 82.1 | — | 0 | 15.6 |
| Comparative Example 4 | FNP-090 | 90.2 | — | 0 | 17.6 |
| Comparative Example 5 | WE-5 | 80.1 | 74.2 | 0.4 | 11.6 |
| Comparative Example 6 | P-420 | 89.1 | 77.4 | 0.2 | 26.5 |

*Sum of areas of the main peak and the secondary peak

Table 4 below shows properties of the toners prepared according to Examples 1-3 and Comparative Examples 1-6 measured by using evaluation methods described below.

TABLE 4

| | HOT | MFT | Degree of Gloss | Image Durability | Charging Stability | HH/LL ratio | High Temperature Durability |
|---|---|---|---|---|---|---|---|
| Example 1 | 205 | 135 | ◎ | ○ | ○ | ◎ | ○ |
| Example 2 | 205 | 134 | ◎ | ○ | ○ | ◎ | ○ |
| Example 3 | 225 | 136 | ◎ | ○ | ○ | ○ | ○ |
| Comparative Example 1 | 200 | 130 | ◎ | X | ○ | X | Δ |
| Comparative Example 2 | 200 | 136 | ◎ | ◎ | ○ | ○ | X |
| Comparative Example 3 | 210 | 139 | X | ○ | X | X | ○ |
| Comparative Example 4 | 215 | 138 | X | ◎ | X | Δ | ○ |
| Comparative Example 5 | 200 | 148 | X | X | ○ | X | X |
| Comparative Example 6 | 230 | 135 | ◎ | X | Δ | X | X |

Referring to Tables 3 and 4, the toners of Examples 1-3 having locations of a main peak and shoulder starting point in a molecular weight distribution curve obtained by GPC method, a molecular weight distribution, locations of a main endothermic peak and a secondary endothermic peak in a DSC thermogram, and a ratio of S1/S2 in a shear storage modulus (G') curve with respect to temperature that all fall within the ranges claimed in the present general inventive concept, due to use of a combination of a low molecular weight binder resin latex and a high molecular weight binder resin latex, and a mixture including an ester-based wax and a paraffin-based wax at an appropriate weight ratio and having a high melting temperature as shown in Table 2 by high Tm1 and Tm2, satisfy a high gloss, a low-temperature fixation, an anti hot-offset property, chargeability and heat storage ability to more than a certain level, compared to the toners of Comparative Examples 1-6 because the binder resins and the mixture wax or releasing agent have a good compatibility therebetween, thereby being able to obtain an optimized extent of the wax component being protruded beyond the surface of the toner particles. In the case of Comparative Example 1, although a mixture wax, designated as P-212, including an ester-based wax and a paraffin-based wax was used, various properties, especially image durability, chargeability under various conditions (HH/LL ratio) and high temperature durability, were unsatisfactory because it has a lower melting temperature and thus does not have a good compatibility with the binder resins. In the case of Comparative Example 6, although a mixture wax, designated as P-420, including an ester-based wax and a paraffin-based wax and having a high melting temperature was used as a releasing agent, an amount of the mixture was as high as more than 13 wt % of the weight of the toner and thus, various properties were unsatisfactory.

Evaluation Method of Toner

<Evaluation of Weight-Average Molecular Weight, Z-Average Molecular Weight, and Molecular Weight Distribution>

A weight-average molecular weight (Mw) and a Z-average molecular weight (Mz) of a toner were measured by gel permeation chromatography (GPC, Alliance Company). 0.1 g of a toner were added to 10 g of THF and stirred for 12 hours at room temperature. An un-dissolved component was removed from the mixture and the resultant mixture was used as a sample.

Refractive index-type (RI) detector (Model: Waters 2414) was used as a detector, and three columns (Model: Strygel HR 5, HR 4, and HR 2) were used. THF was used as an eluent, and a flow rate was 1 ml/min. A concentration of the sample used was 1 wt %, and a volume of the injected sample was 50 μl. Ten reference polystyrene solutions each with a concentration of 0.5 wt % were used for calibration. Conditions for the respective reference polystyrene solutions were as follows:

Reference polystyrene (PS) solution 1: a mixed solution of PS having a molecular weight of 1,200/PS having a molecular weight of 7,210/PS having a molecular weight of 196,000/PS having a molecular weight of 257,000/PS having a molecular weight of 1,320,000/THF with a volumetric ratio of 1:1:1:1:0.5:0.5; and Reference polystyrene solution 2: a mixed solution of PS having a molecular weight of 3,070/PS having a molecular weight of 49,200/PS having a molecular weight of 113,000/PS having a molecular weight of 778,000/PS having a molecular weight of 3,150,000/THF with a volumetric ratio of 1:1:1:1:0.5:0.5.

<Rheological Property Evaluation>

Rheological properties of a toner, for example, storage moduli of G'(80), G'(100) or the like were measured at temperatures of 80° C. and 100° C. according to a sinusoidal wave vibration method with measuring conditions including the frequency of 6.28 rad/s and the heating rate of 2.0° C./min using a dynamic mechanical analyzer (DMA, TA ARES) manufactured from Rheometric Scientific, Inc. Slopes S1 and S2 were calculated from the values of G'(40), G'(50), G'(80), G'(100) or the like.

Fixing Latitude Evaluation>

A test image was fixed by using a 2 roll-type fixing unit (nip: 11 mm, pressure: 14.5 kgf) under the following conditions:

Unfixed image for test: 100% solid pattern having a toner mass per area (TMA) of 0.45 to 0.5 mg/cm$^2$;

Test temperature: 100-250° C. (10° C. interval);

Fixing speed: 334 mm/sec (55 prints per minute (ppm));

Test paper: 80 g paper (double A of Xerox Company).

Fixability of a fixed image was evaluated as follows: After measuring optical, density (OD) of the fixed image, 3M 810 tape was adhered to a portion of the image and the tape was removed after reciprocating five times using a 500 g weight. The optical density (OD) was measured after removing the tape.

Fixability was evaluated by the following equation:

$$\text{Fixability}(\%)=(\text{Optical density after tape peeling}/\text{Optical density before tape peeling})\times 100.$$

A fixing temperature range having a fixability value of 90% or more is regarded as a fixing range of a toner. A minimum temperature having the fixability value of 90% or more without cold-offset is defined as a minimum fixing or fusing temperature (MFT). A minimum temperature at which hot-offset occurs is defined as a hot offset temperature (HOT).

<Gloss Evaluation>

In order to measure a gloss property, an image was printed (temperature of the fixing unit: about 160° C.) using a color laser printer (manufacturer: Samsung Electronics Co., Ltd, model: Color Laser CLP 320) and a degree of gloss of the image was measured by using a gloss measuring instrument, a glossmeter (manufacturer: BYK Gardner, model: micro-TRI-gloss).

Evaluation angle: 60°

Evaluation pattern: 100% solid pattern

Evaluation paper: 80 g paper (double A of Xerox Company)

The gloss property was evaluated as follows:

◎ more than 10

○: 7 or more and 10 or less

Δ: 3 or more and less than 7

X: less than 3.

<Heat Storage Ability Evaluation>

100 g of a toner was externally added as described in Example 1, and then put into a developer (manufacturer: Samsung Electronics Co., Ltd, model: developer of Color Laser 660) and stored in packaged state in a constant-temperature and constant-humidity oven under the following conditions:

23° C., 55% relative humidity (RH), 2 hours

⇒ 40° C., 90% RH, 48 hours

⇒ 50° C., 80% RH, 48 hours

⇒ 40° C., 90% RH, 48 hours

⇒ 23° C., 55% RH, 6 hours.

After storing under the above conditions, the presence of toner caking in the developer was identified with the naked eye and image defects were evaluated by printing a 100% solid pattern.

After the preservation under the conditions described above, it was identified with the naked eye whether caking occurred in toner in the developer, and a 100% solid pattern was printed and image defect was evaluated.

Evaluation Criteria

○: Good image, no caking

Δ: Inferior image, no caking

X: Occurrence of caking.

<Toner Charging Evaluation>

25 g of magnetic carriers (manufacturer: KDK, model: SY129), and 1.5 g of a toner were added in a 60 ml glass container and then stirred using a tubular mixer. Then, the charge quantity of the toner was measured using an electric field separation method.

Under room temperature and room humidity conditions (23° C., 55% RH), a charge stability of the toner according to stirring time was evaluated.

Room temperature and room humidity: 23° C., 55% RH

High temperature and high humidity (HH): 30° C., 80% RH

Low temperature and low humidity (LL): 10° C., 10% RH.

Charge stability was evaluated under the room temperature and room humidity conditions as follows.

○: the case where a charge saturation curve according to stirring time is smooth and the fluctuation range thereof is insignificant after charge saturation.

Δ: the case where a charge saturation curve according to stirring time is a little fluctuated and the fluctuation range thereof is small after charge saturation (up to 30%).

X: the case where charge according to stirring time is not saturated and the fluctuation range thereof is considerably large after charge saturation (greater than 30%).

Also, the ratio of a charging amount under high temperature and high humidity to a charging amount under low temperature and low humidity (HH/LL ratio) was evaluated as charge stability according to environmental change as follows:

Evaluation Criteria

◎: HH/LL-ratio of greater than 0.65

○: HH/LL ratio of 0.55 or more and 0.65 or less

Δ: HH/LL ratio of 0.45 or more and 0.55 or less

X: HH/LL ratio of less than 0.45.

<Average Circularity Evaluation>

The shape of the prepared toners was identified with SEM photographs. The circularity of the toner was calculated based on the following formula using FPIA-3000 from SYSMEX Corporation.

$$\text{Circularity}=2\times(\pi\times\text{area})^{0.5}/\text{circumference}. \qquad \text{<Formula>}$$

A value of circularity is in the range of 0 to 1, and a toner particle becomes spherically shaped as the value of circularity approaches 1. The average circularity was calculated by averaging circularity values of 3,000 toner particles.

<Particle Size Distribution Evaluation>

A volume average particle size distribution index GSDv and a number average particle size distribution index GSDp, which are particle size distribution indices of toner particles, were measured under the following conditions using a Multisizer III measuring instrument (from Beckman Coulter, Inc) which is a Coulter counter.

Electrolyte: ISOTON II

Aperture Tube: 100 μm

Measured particle number: 30,000

From the measured particle size distribution of the toner, a cumulative distribution for volume and number of individual toner particles was plotted as a divided particle size range (i.e., channel) in order of increasing diameter. A particle diameter at cumulative 16% is defined as volume average particle size D16v and number average particle size D16p, and a diameter at cumulative 50% is defined as volume average particle size D50v and number average particle size D50p. Similarly, a particle diameter at cumulative 84% is defined as volume average particle size D84v and number average particle size D84p. GSDv and GSDp are calculated by using the following equations.

$$GSDv=(D84v/D16v)^{0.5}$$

$$GSDp=(D84p/D16p)^{0.5}.$$

<Image Durability Evaluation>

A 1% coverage pattern was continuously printed by using a printer (manufacturer: Samsung Electronics Co., Ltd, model: developer of Color Laser 660), and then, it was identified how long an image concentration of a solid pattern was maintained. Image durability was evaluated on the following scale.

◎: maintaining constant image concentration for printing 5000 or more sheets

○: maintaining constant image concentration for printing 3000 or more and less than 5000 sheets Δ: maintaining constant image concentration for printing 1000 or more and less than 3000 sheets X: printing constant image concentration for less than 1000 sheets Regarding toners according to embodiments of the present general inventive concept above, a low molecular weight binder resin having a function with respect to a minimum fixing temperature (MFT) and a gloss property and a high molecular weight binder resin that contributes to anti-offset properties due to elasticity maintenance characteristics at higher temperatures may independently perform their functions. Accordingly, according to the above embodiments of the present general inventive concept, a high gloss property, a low-temperature fixation, an anti hot-offset property, and heat storage ability may be satisfied to certain levels or higher. Accordingly, according to the present general inventive concept, a standardized toner for developing an electrostatic charge image whose fixing latitude is barely changed even when a printing speed is changed, may be obtained.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner to develop an electrostatic charge image, the toner comprising:

a binder resin including:

a first binder resin having a first weight-average molecular weight; and a second binder resin having a second weight-average molecular weight different than the first weight-average molecular weight;

a colorant; and a releasing agent, wherein the toner has at least one endothermic peak corresponding to melting of the releasing agent, and the at least one endothermic peak is obtained by differential scanning calorimetry (DSC) and includes a main endothermic peak in a temperature range of about 80 to about 100° C. and a secondary endothermic peak in a temperature range of about 60 to about 80° C., and wherein a molecular weight distribution curve of the toner obtained by using the gel permeation chromatography (GPC) method on the tetrahydrofuran (THF) soluble fraction includes a main peak in a molecular weight range of about 10,000 to about 30,000 g/mol and a shoulder starting point in a molecular weight range of about 100,000 to about 300,000 g/mol, and characteristics of the molecular weight distribution curve of the toner include:

an amount of molecules having a molecular weight greater than 5,000,000 g/mol is about 0.1 to about 1 wt % based on a total weight of the THF soluble fraction, an amount of molecules having a molecular weight in a range of 1,000,000 g/mol to 5,000,000 g/mol is about 0.5 to about 3 wt % based on the total weight of the THF soluble fraction, an amount of molecules having a molecular weight in a range of 100,000 g/mol to 500,000 g/mol is about 3 to about 10 wt % based on the total weight of the THF soluble fraction, and an amount of molecules having a molecular weight of 20,000 g/mol or less is about 45 to about 70 wt % based on the total weight of the THF soluble fraction.

2. The toner of claim 1, wherein the toner has a weight-average molecular weight of about 30,000 to about 500,000 g/mol and a Z-average molecular weight of about 100,000 to about 50,000,000 g/mol, determined from a molecular weight measurement by using the gel permeation chromatography (GPC) method on the tetrahydrofuran (THF) soluble fraction.

3. The toner of claim 1, wherein the releasing agent comprises:

a paraffin-based wax; and an ester-based wax in an amount of about 10 wt % to about 50 wt % based on a total weight of the paraffin-based wax and the ester-based wax, and a difference between a solubility parameter (SP) of the binder resin and a SP of each of the paraffin-based wax and the ester-based wax is about 2 or more.

4. The toner of claim 1, wherein an amount of the releasing agent of the toner is about 9 wt % to about 13 wt % based on a total weight of the toner.

5. The toner of claim 1, wherein a height ratio of the secondary endothermic peak to the main endothermic peak is about 0.2 to about 0.5.

6. The toner of claim 1, wherein a temperature (Ts) at which a shear storage modulus of the toner begins to decrease in a shear storage modulus (G') curve of the toner with respect to temperature is about 54° C. to about 67° C.

7. The toner of claim 1, wherein in a shear storage modulus (G') curve of the toner with respect to temperature, S1 represents a value of [log G'(80)−log G'(100)]/20 and is about 0.03 to about 0.1, S2 represents a value of [log G'(110)−log G'(160)]/50 and is about 0.01 to about 0.05, a ratio of S1/S2 is about 1.4 to about 5.0, and G'(160) is about 100 to about 3,000, wherein G'(80), G'(100), G'(110), and G'(160) respectively denote shear storage moduli (Pa) at temperatures of 80° C., 100° C., 110° C., and 160° C. at an angular velocity of about 6.28 rad/s, a heating rate of about 2.0° C./min., and an initial strain of about 0.3%.

8. The toner of claim 1, further comprising:

a coagulant including about 1,000 to about 10,000 ppm of iron (Fe) and about 1,000 to about 5,000 ppm of silicon (Si).

9. The toner of claim 1, wherein the toner has a core-shell structure comprising:

a core including the binder resin, the colorant and the releasing agent; and a shell layer covering the core layer to suppress exposure of the colorant or releasing agent.

* * * * *